US008006533B2

(12) United States Patent
Ikeda

(10) Patent No.: US 8,006,533 B2
(45) Date of Patent: Aug. 30, 2011

(54) FLANGED HOUSING MEMBER, FORMING METHOD AND FORMING DEVICE

(75) Inventor: Akihiko Ikeda, Kawasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 1039 days.

(21) Appl. No.: 11/606,906

(22) Filed: Dec. 1, 2006

(65) Prior Publication Data

US 2007/0131014 A1 Jun. 14, 2007

(30) Foreign Application Priority Data

Dec. 9, 2005 (JP) ..... 2005-356972
Dec. 9, 2005 (JP) ..... 2005-356978
Aug. 11, 2006 (JP) ..... 2006-219741

(51) Int. Cl.
*B21D 22/06* (2006.01)
*B21D 22/00* (2006.01)

(52) U.S. Cl. ..... 72/356; 72/352; 72/353.2

(58) Field of Classification Search ..... 72/352, 72/356, 267, 256, 353.2, 354.6, 355.2, 358–361
See application file for complete search history.

(56) References Cited

U.S. PATENT DOCUMENTS 5,374,219 A 12/1994 Kohara et al.
5,632,682 A 5/1997 Krude et al.

FOREIGN PATENT DOCUMENTS

| | | |
|---|---|---|
| DE | 4411515 | 8/1995 |
| DE | 19858324 | 3/2000 |
| JP | 57-056124 | 4/1982 |
| JP | 63-273523 | 11/1988 |
| JP | 02-025223 | 1/1990 |
| JP | 03-081043 | 4/1991 |

*Primary Examiner* — Debra Sullivan
(74) *Attorney, Agent, or Firm* — Global IP Counselors, LLP

(57) ABSTRACT

A flanged housing member is formed using a forming method and a forming device from a forming material having a pre-flanged forming portion 2 is disposed at one end of a trunk portion 1. The entire external surface of the flanged housing member can be ironed with a sufficient degree of precision without mechanical machining. The forming material is held on one of a first die having an external forming surface and a second die having an internal forming surface. A sizing process is performed to at least form an internal surface of the trunk portion using the first and second dies. The pre-flanged forming portion is sandwiched and pressed between the first die and a flange-forming die to form a flange portion on the end of the trunk portion.

16 Claims, 17 Drawing Sheets

(A)

(B)

(A)

(B)

FLANGED HOUSING MEMBER, FORMING METHOD AND FORMING DEVICE

CROSS-REFERENCE TO RELATED APPLICATIONS

This application claims priority to Japanese Patent Application Nos. 2005-356972, filed on Dec. 9, 2005, 2005-356978, filed on Dec. 9, 2005, and 2006-219741, filed on Aug. 11, 2006. The entire disclosures of Japanese Patent Application No. 2005-356972, 2005-356978 and 2006-219741 are hereby incorporated herein by reference.

BACKGROUND OF THE INVENTION

1. Field of the Invention

The present invention generally relates to a flanged housing member in which a flange is disposed at one end of a trunk portion. More specifically, the present invention relates to ironing process, which is a kind of cold workings, that is being used to form a flange portion on a tubular trunk portion in which the flange portion and the trunk portion are formed as a one-piece, unitary member.

2. Background Information

A vehicle power train includes a rotation torque transmitting device that often has a constant-velocity joint. The constant-velocity joint sometimes has an outer ring that is a flanged housing member having a trunk portion with a blind bore and a flange protruding outward from the closed end of the trunk portion portion. The blind bore of the trunk portion can be provided with a plurality of tracks or grooves formed in its internal surface such that a gauge guide surface is formed between the tracks or grooves.

One conventional method for forming such a flanged housing member involves first forming the internal and external surfaces of the trunk portion and then thereafter welding a flange to one end of the trunk portion to close the end of the trunk portion. However, this is disadvantageous from the aspect of cost in that two components, i.e., a flange and a trunk portion, are required to be welded together.

Also, another conventional method involves a hot-forging process in which a flanged forged material is first formed with a through-hole. Thereafter, the external surface of the flanged forged material is machined to achieve a prescribed outside diameter and to obtain a prescribed flange and other components. In this method, the tracks or grooves and the gauge guide surfaces in the internal surface are formed by broaching and performing induction hardening. Then, in this method, a cover is attached to one end of the trunk portion. In this method, however, machining and broaching require processing time, with broaching itself being costly. Thus, this manufacturing process is inferior in terms of manufacturing costs.

Another conventional method of manufacturing a flanged cylindrical member that has a through-hole is disclosed in Japanese Laid-Open Patent Application No. 02-025223 (Japanese Patent No. 2661669). In this publication, a method is disclosed in which the flanged cylindrical member is formed using a cold forming process. This cold forming process includes using a punch to finishing the internal surface of the trunk portion. In this cold forming process, the punch is inserted into the trunk portion from the opposite side of the flange, and a die is then thereafter inserted from the same direction as the punch to shape the external surface of the trunk portion.

A conventional method of manufacturing a flanged cylindrical member that has a blind bore is disclosed in Japanese Laid-Open Patent Application No. 63-273523. In this publication, a method is disclosed in which the flanged cylindrical member is formed using a cold forming process. Here, a forged workpiece is supported with its flange side facing downward. Then, a punch for finishing the interior surface is inserted inside the trunk portion, and an ironing die divided into a plurality of parts along the axial center is disposed on the external surface to shape the external surface of the workpiece by moving the punch or the ironing die in the axial direction and passing the workpiece through the interior of the die. Thus, the internal surface of the workpiece is brought into close contact with the external surface of the punch, and the internal and external surfaces of the workpiece are finished.

In view of the above, it will be apparent to those skilled in the art from this disclosure that there exists a need for an improved flanged housing member. This invention addresses this need in the art as well as other needs, which will become apparent to those skilled in the art from this disclosure.

SUMMARY OF THE INVENTION

It has been discovered that the above mentioned processes, have certain drawbacks. In the process disclosed in Japanese Laid-Open Patent Application No. 02-025223 (Japanese Patent No. 2661669), it has been discovered that when the external surface is formed using a die on the flanged housing member, the flange will naturally become an obstruction and ironing cannot be applied across the entire external surface. For this reason, sufficient precision tends not to be achieved overall. Also, when the product is removed from the die, the precision may be further reduced because the ironing die re-irons the external periphery.

In the process disclosed in Japanese Laid-Open Patent Application No. 63-273523 (see Claims and FIG. 1) it has been discovered that the same problem exists as the process of Japanese Laid-Open Patent Application No. 02-025223 (Japanese Patent No. 2661669). In addition, since the workpiece must be cut in advance, the lead time is increased and the manufacturing costs are also increased. There is also a drawback in that the strength may be compromised because the grain flow is severed by the cutting process.

The present invention was contrived to in view of these problems of the above mentioned methods. One object of the present invention is to provide a flanged housing member, and a forming method and device thereof, in which an entire external surface of the flanged housing member can be formed such that the number of components can be reduced, the lead time can be shortened, and the manufacturing process can be improved at least from the aspect of cost.

In accordance with one aspect of the present invention, a flanged component forming method is provided to form a flanged housing member. The flanged component forming method basically comprises holding a forming material having a pre-flanged forming portion that is disposed at one end of a trunk portion; sizing at least an internal surface of the trunk portion using a first die having an external forming surface and a second die having an internal forming surface; and sandwiching and pressing the pre-flanged forming portion between the first die and a flange-forming die to form a flange portion on the end of the trunk portion.

As used herein, the term "sizing" refers to applying pressure to a workpiece by using a die in order to improve dimensional precision. Also as used herein, the term "flange" commonly refers to a portion that protrudes outwardly in a radial direction from an external surface of a trunk portion. The term "closure" refers solely to a portion that closes an end portion of a trunk portion. Unless otherwise described in the present specification, the term "flange" will refer to the portion that is integrally formed with the closure for closing the end portion of the trunk portion.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
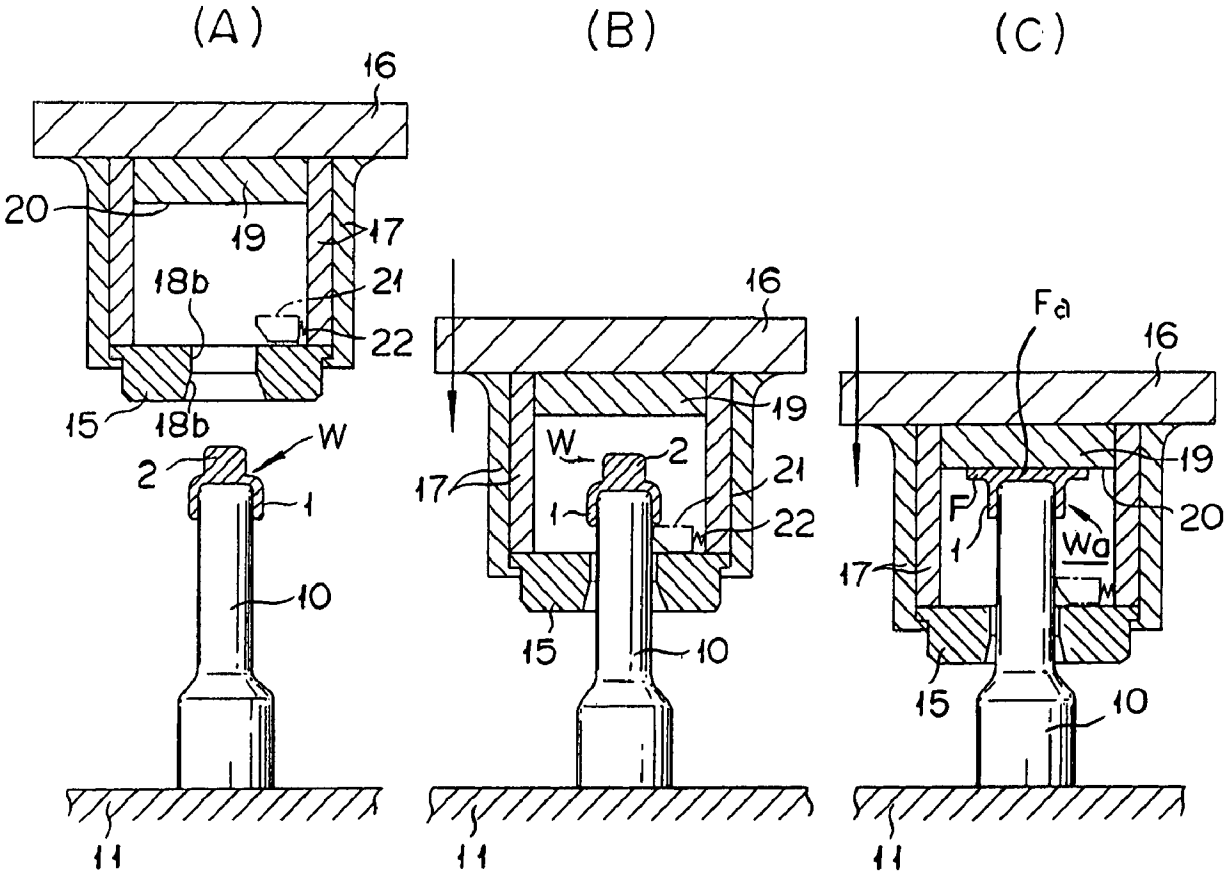
FIG. 1 is a series of simplified schematic diagrams (A) to (C), in cross-section, showing a sequence of steps in a flanged component forming method in accordance with a first embodiment of the present invention.

Referring initially to FIG. 1, a series of simplified schematic diagrams (A) to (C) are illustrated to show a flanged component forming method in accordance with a first embodiment of the present invention. Basically, the flanged component forming method of the first embodiment of the present invention includes providing a forming material W that is reshaped to a flanged housing member (formed article) Wa as explained below. The forming material W is preferably a relatively hard metal material that is deformable using cold forming and/or warming forming processes as described herein to form the flanged housing member (formed article) Wa as explained below.

The forming material W basically includes a cylindrical (i.e., tubular) trunk portion 1 with a blind internal bore and a pre-flanged forming portion 2 that is deformed to form a flange portion F. The trunk portion 1 and the flange portion F are formed as a one-piece, unitary member in the flanged housing member (formed article) Wa. By way of example, the formed article Wa can be used for an outer ring of a constant-velocity joint that is used into a rotating torque transmitting mechanism of a vehicle engine. Therefore, the pre-flanged forming portion 2 is disposed so as to close the opening at one end of the trunk portion 1. The trunk portions 1 of this embodiment and the following embodiments are used for the outer ring of a constant-velocity joint, and thus, the cross section of the trunk portion 1 is circular. However, the present invention can also be applied to other components, and the cross-section of the trunk portion 1 is therefore not necessarily required to be circular. A rectangular cross section or another irregular shape can be used.

Figure 2:
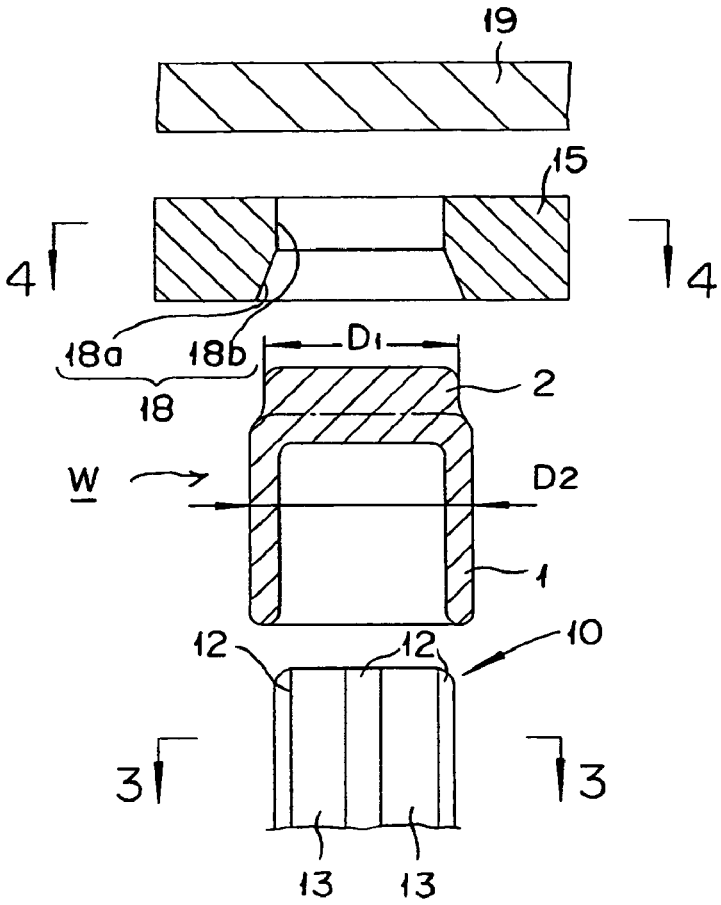
FIG. 2 is an exploded cross-sectional view showing the main parts of the flanged component forming device used in the flanged component forming method in accordance with the first embodiment of the present invention.

As seen in FIGS. 1 and 2, the main parts of a flanged component forming device are in cross-section in accordance with the first embodiment of the present invention. The flanged component forming device basically includes a punch 10 mounted on a base 11, a sizing die 15 mounted on a press ram 16 by a support member 17 so that the sizing die 15 can be lifted and lowered relative to the punch 10, and a flange-forming die 19 for sandwiching and pressing the pre-flanged forming portion 2. The punch 10 basically constitutes a "first die" that is configured and arranged to form an internal surface of the trunk portion 1 of the forming material W. The sizing die 15 basically constitutes a "second die" that is configured and arranged to form an external surface of the trunk portion 1 of the forming material W and squeeze the trunk portion 1 of the forming material W against the punch 10 ("first die") to form an internal surface of the trunk portion 1 of the forming material W.

Figure 3:
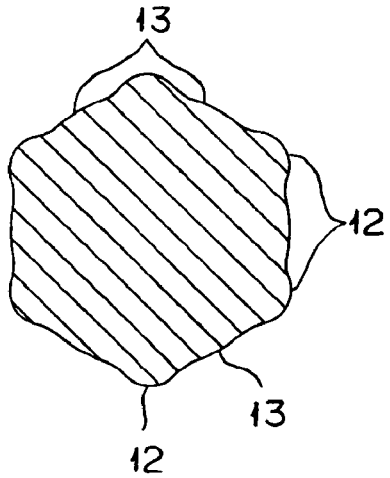
FIG. 3 is a simplified schematic cross-sectional view of the punch as viewed along section line 3-3 of FIG. 2.
Figure 4:
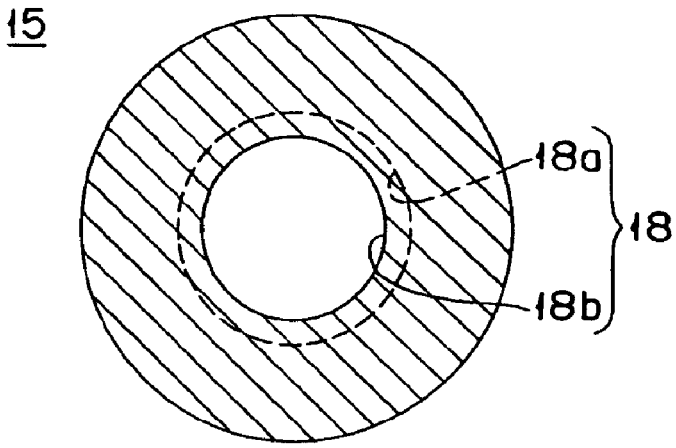
FIG. 4 is a simplified schematic cross-sectional view of the sizing die as viewed along section line 4-4 of FIG. 2.

FIG. 3 is a simplified schematic cross-sectional view of the punch as viewed along section line 3-3 of FIG. 2. FIG. 4 is a simplified schematic cross-sectional view of the sizing die as viewed along section line 4-4 of FIG. 2.

The method for forming a flanged housing member is described first. The forming material W is held on the punch 10 ("first die"), as shown in diagram (A) of FIG. 1. The forming material W is ironed in cooperation with the sizing die 15 ("second die"), as shown in diagram (B) of FIG. 1. Thus, the internal and external surfaces of the trunk portion 1 are sized using the punch 10 and the sizing die 15. The pre-flanged forming portion 2 is deformed to form a flange portion F, as shown in diagram (C) of FIG. 1.

Following is a more detailed description. The flanged component forming device used in this case uses the punch 10 to hold the forming material W. The punch 10 has an external surface (also referred to as "external forming surface" for simplification of description) that constitutes a forming surface of the forming material W. The sizing die 15 is used to iron the forming material W held by the punch 10 for sizing the internal and external surfaces of the trunk portion 1 of the forming material W. Thus, the sizing die 15 has an internal surface (also referred to as "internal forming surface" for simplification of description) that constitutes a forming surface of the external surface of the trunk portion 1 of the forming material W. The flange-forming die 19 is configured and arranged for sandwiching and pressing the pre-flanged forming portion 2 against the punch 10, as shown in FIG. 2, to form the flange portion F (see diagram (C) of FIG. 1).

The punch 10 is a pillar-shaped body disposed upright in a fixed position on the base 11, as shown in diagram (A) of FIG. 1. The upper portion of the punch 10 is provided with an external forming surface having a plurality of protruding splines 12 and a plurality of concave grooves 13 disposed an alternately manner. The protruding splines 12 are used to form a plurality of tracks or grooves on the internal surface of the trunk portion 1. The concave grooves 13 are used to form a gauge guide surface between the tracks or grooves on the internal surface of the trunk portion 1, as shown in FIGS. 2 and 3.

The sizing die 15 is mounted by way of the support member 17 on the press ram 16 so as to be lifted and lowered relative to the punch 10. The sizing die 15 is a ring-shaped member having a center-positioned opening 18 for ironing the trunk portion 1 of the forming material W whereby the forming material W is pressed against the external surface of the punch 10, as shown in FIGS. 2 and 4. However, the internal forming surface is not limited to an arcuate surface, and can be a surface having various shapes. The substantially lower half of the opening 18 in the present embodiment includes a tapered portion 18*a*, while the substantially upper half of the opening 18 in the present embodiment includes a cylindrical portion 18*b*. The tapered portion 18*a* is used in order to facilitate the ironing of the forming material W. The cylindrical portion 18*b* is used in order to size the forming material W to a prescribed outside diameter.

Figure 5:
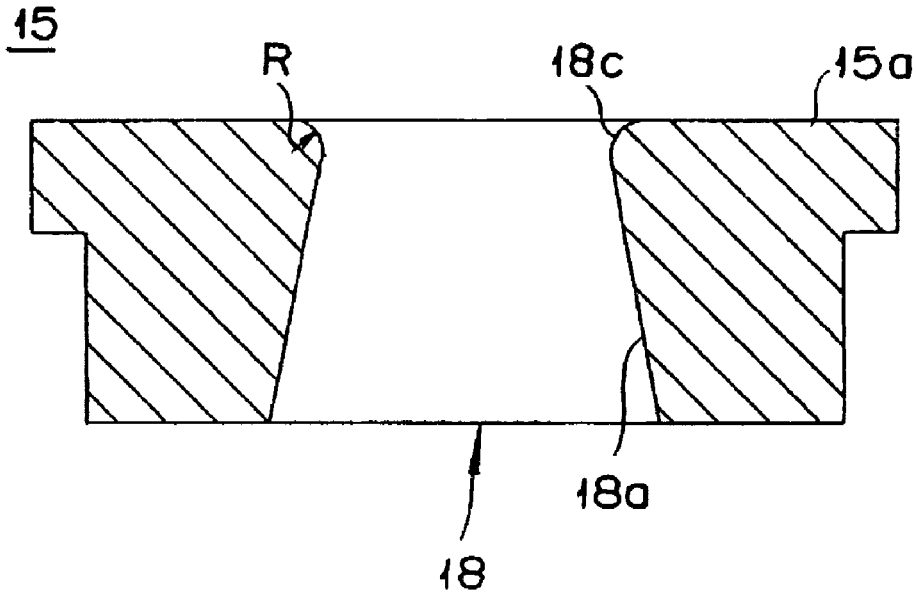
FIG. 5 is a simplified schematic cross-sectional view of a modified sizing die showing a modification of the previously illustrated sizing die.

Alternatively, as shown in FIG. 5, the cylindrical portion 18*b* of the opening 18 of the sizing die 15 can essentially eliminated if needed and/or desired. In particular, tapered portion 18*a* can extend to an arcuate portion 18*c* such that the intersecting point has an internal size (diameter or width) and shape that corresponds to the size and shape of the formed article Wa. Thus, the arcuate portion 18*c* has a prescribed radius R, with the tapered portion 18*a* is rectilinearly sloped away from the arcuate portion 18*c*.

In the present embodiment, the flange-forming die 19 is disposed on the press ram 16, and the lower surface thereof is a plate-shaped member which forms a flat pressing surface 20. However, it will be apparent to those skilled in the art from this disclosure that other configurations are possible.

Preferably, a removal member 21, such as that shown by the dotted line in FIG. 1, is disposed in the flanged component forming device on an upper portion of the sizing die 15, for example, in order to remove the forming material W from the punch 10 after forming. The removal member 21 can be spring loaded and urged toward the center by a spring 22 disposed at the back end. The distal end of the removal member 21 is preferably a tapered surface so as to facilitate the passage of the forming material W.

The pre-flanged forming portion 2 is preferably configured so that the outside diameter D1 of the pre-flanged forming portion 2 is equal to or less than the outside diameter D2 of the trunk portion 1, as shown in FIG. 2. The outside diameter D1 of the pre-flanged forming portion 2 is more preferably less than the minimum inside diameter of the opening 18 with the outside diameter D2 of the trunk portion 1 being larger than the minimum inside diameter of the opening 18. The entry of the pre-flanged forming portion 2 into the opening 18 is thereby facilitated, sizing is more easily performed by ironing against the external periphery of the trunk portion 1 which has an outside diameter that is slightly greater than the inside diameter of the opening 18. Thus, reduced precision can be prevented in the formation of the formed article Wa when produced in accordance with the present invention.

In the present embodiment, the flange-forming die 19 that forms the pre-flanged forming portion 2 preferably performs the process of sandwiching and pressing the pre-flanged forming portion 2 immediately after the sizing die 15 has sized the entire length of the trunk portion 1, or while the sizing die 15 is moving with respect to the forming material W. The process of sandwiching and pressing by the flange-forming die 19 can also be performed midway during the sizing process performed by the sizing die 15.

Therefore, the flange-forming die 19 can be disposed directly below the press ram 16, as shown in FIG. 1, so that the space between the flange-forming die 19 and the sizing die 15 provides a distance sufficient to allow the punch 10 that accompanies the forming material W to enter into the space. Although not depicted, the flange-forming die 19 can also be disposed in a position underneath and at a distance from the press ram 16, and the formation of the pre-flanged forming portion 2 can begin immediately when the punch 10 that accompanies the forming material W enters the above-described space.

In other words, the sandwiching and pressing position at which the flange-forming die 19 sandwiches and presses the forming material W can be a passage position in which the punch 10 has completed sizing across the entire axial length of the trunk portion 1 of the forming material W, or can be a midway position in the axial direction of the of the trunk portion 1. As used herein, the term "passage position" refers a position that immediately follows sizing, or can be a position that occurs during the relative movement of the punch 10 and the sizing die 15.

Following is a description of the flanged component forming method will be presented in more detail.

First, the forming material W is set on the upper portion of the punch 10, and the press ram 16 is lowered as shown in diagram (A) of FIG. 1. The forming material W is ironed by the tapered portion 18*a* and the cylindrical portion 18*b* of the sizing die 15, as shown in diagram (B) of FIG. 1, and is sized to a prescribed outside diameter. As a result, the shapes of the protruding splines 12 and the concave grooves 13 of the punch 10 are transferred, and the tracks or grooves and the gauge guide surface are formed on the trunk portion 1 of the forming material W. This ironing process is performed across the entire axial length of the trunk portion 1 of the forming material W, and thus the trunk portion 1 is formed with a high degree of precision across the entire body of the trunk portion 1 of the forming material W.

Furthermore, when the press ram 16 is lowered, the pressing surface 20, which is the lower surface of the flange-forming die 19, fashions the pre-flanged forming portion 2 of the forming material W on the punch 10 to a prescribed thickness. This results in the pre-flanged forming portion 2 of the forming material W on the punch 10 to produce the formed article Wa having the flange portion F, as shown in diagram (C) of FIG. 1.

In the present embodiment, the forming material W can thus be sized, the tracks or grooves and the gauge guide surface can be formed, and the flange portion F can all be produced in a single pressing process. Therefore, the formed article Wa can be obtained in a very simple manner. If the forming material W is temporarily detached from the punch 10 when the flange portion F is formed in another step, then the shape of the internal surface of the trunk portion 1 tends to deform after forming, and precision tends to be compromised. However, in the present embodiment, since the flange is formed without detaching the forming material W from the punch 10, a very high degree of precision is achieved across the entire length of trunk portion 1.

Since the trunk portion 1 and the flange portion F can be integrated into the formed article Wa by carrying out the formation in a single press process that includes the flange portion as well, the flange portion does not need to be welded on afterward. Also since the heat of welding is not applied, the formed article Wa with excellent strength can be formed that is thinner and more lightweight then with other types of processes that use welding. Also, not only can costs be thereby reduced, but because heat deformation does not occur, precision is improved, acoustic vibration characteristics are improved, the occurrence of joint knockings is prevented, and joint characteristics are improved in comparison to other types of processes that use welding. The number of components and steps can also be reduced.

More specifically, when a formed article is obtained by hot forging in a conventional manner, the so-called draft angle must be increased and internal burrs generated within the trunk portion 1 must be removed. Therefore, the precision of the formed article is reduced and the inner surface of the trunk portion tends to be damaged. However, since hot forging is not required to be used in the present embodiment, the draft angle does not need to be increased, the inside of the trunk portion 1 can be easily sized, high sizing precision is obtained, and a decarburized layer is not formed.

When the press ram 16 is moved upward, the distal end of the removal member 21 can engage the formed article Wa and be removed from the upper portion of the punch 10. The formed article Wa is removed from the die by an ejection mechanism (not shown).

In the present embodiment, the flange portion F is integrally formed with the closure Fa, as shown in diagram (C) of FIG. 1, but in some cases, the flange does not have a closure Fa, i.e., the flange can be formed having only the portion protruding in the radial direction from the external surface of the trunk portion. In order to obtain such a formed article, a forming material W must be used in which the pre-flanged forming portion 2 is cylindrically shaped.

Second Embodiment

Figure 6:
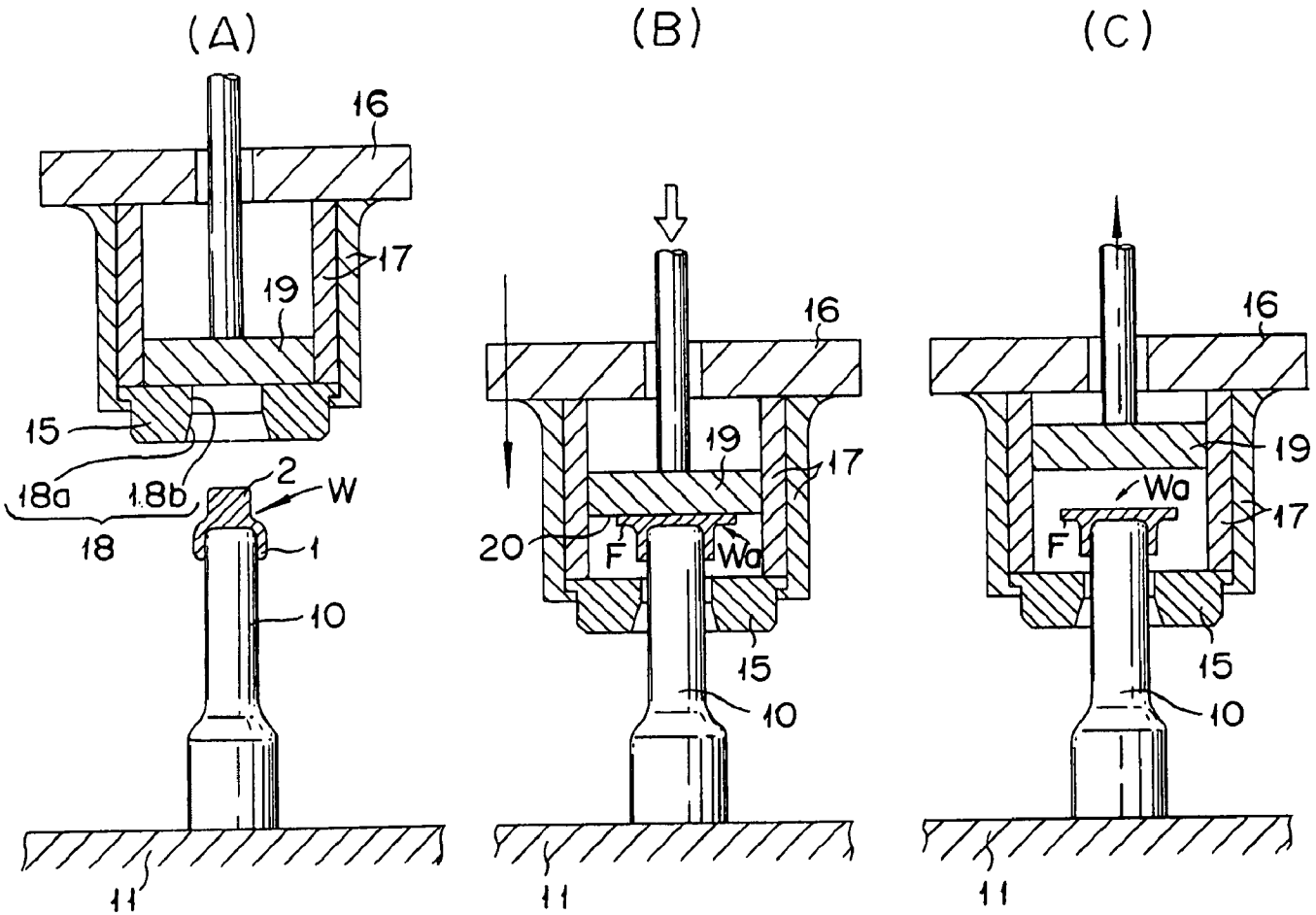
FIG. 6 is a series of simplified schematic diagrams (A) to (C), in cross-section, showing a sequence of steps in a flanged component forming accordance with a second embodiment of the present invention.

Referring now to FIG. 6, a flanged component forming method in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts and steps of the second embodiment that are identical to the parts and steps of the first embodiment may be omitted for the sake of brevity. Diagrams (A) to (C) of FIG. 6 schematically illustrate the flanged component forming method according to the second embodiment of the present invention in cross-section. In the flanged component forming method according to the second embodiment of the present embodiment, the flange-forming die 19 is operated by an independent lifting mechanism (not shown), which is different than the first embodiment.

In this forming method, the forming material W is first set on the upper portion of the punch 10, as shown in diagram (A) of FIG. 6, and the flange-forming die 19 is lowered to the vicinity of the sizing die 15 using the lifting mechanism.

Next, when the press ram 16 is lowered, as shown in diagram (B) of FIG. 6, the forming material W is ironed by the sizing die 15 in the same manner as in the first embodiment described above. Thus, the forming material W is sized to a prescribed outside diameter, and tracks or grooves and the gauge guide surface are formed on the trunk portion 1. The ironing is also performed over the entire axial length of the trunk portion 1 of the forming material W. Therefore, the formed trunk portion 1 is provided with a high degree of precision over the entire length.

In the present embodiment, the flange-forming die 19 is lowered to the vicinity of the sizing die 15, and pressure is applied by the lifting mechanism. The forming material W ironed by the sizing die 15 that is held on the punch 10. Therefore, the pre-flanged forming portion 2 deformed by the pressing surface 20, which is the lower surface of the flange-forming die 19, such that the pre-flanged forming portion 2 is pressed, and the flange portion F is formed to a prescribed thickness. Specifically, the position in which the pre-flanged forming portion 2 is sandwiched and pressed in the present embodiment is different from that of the first embodiment. The pre-flanged forming portion 2 is sandwiched and pressed by the flange-forming die 19 when a distal end of the punch 10 and a back surface of the sizing die 15 are aligned at substantially the same time as sizing. In the present specification, the term "align" refers to a situation in which the distal end (upper free end surface) of the punch 10 and the back surface (upper surface facing the flange-forming die 19) of the sizing die 15 are in a matching arrangement in the movement directions of these two components.

After the flange portion F is formed, the flange-forming die 19 is raised by the lifting mechanism at the same time the press ram 16 is raised or after formation is completed. The forming material W is removed by engaging the formed article Wa with the aid of the removal member 21 disposed in a position that does not interfere with the flange-forming die 19, and detaching the article from the punch 10. The article is removed from the die by an ejection mechanism (not shown).

In the present embodiment as well, the forming material W can be sized, tracks or grooves and the gauge guide surface can be formed, and various other effects can be achieved in a single press operation in the same manner as in the first embodiment described above.

Third Embodiment

Figure 7:
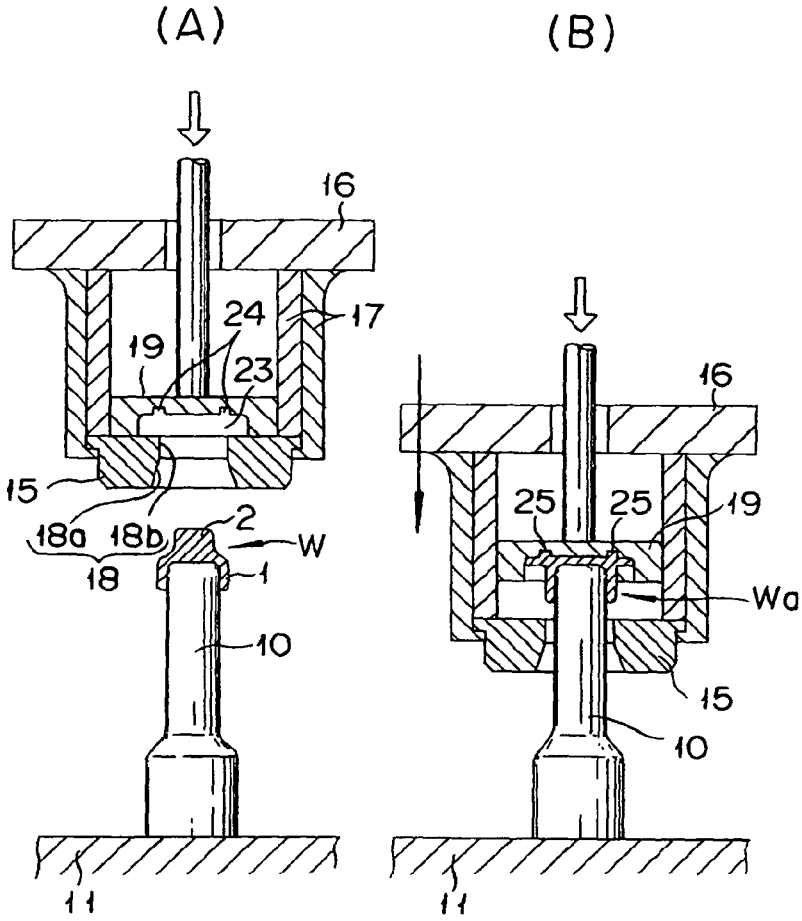
FIG. 7 is a pair of simplified schematic diagrams (A) and (B), in cross-section, showing a sequence of steps in a flanged component forming method in accordance with a third embodiment of the present invention.

Referring now to FIG. 7, a flanged component forming method in accordance with a third embodiment will now be explained. In view of the similarity between the prior embodiments and the third embodiment, the parts of the third embodiment that are similar to the parts of the prior embodiment will be given the same reference numerals as the parts of the prior embodiments. Moreover, the descriptions of the parts and steps of the third embodiment that are similar to the parts and steps of the prior embodiments may be omitted for the sake of brevity. Diagrams (A) and (B) of FIG. 7 schematically illustrate the flanged component forming method according to the third embodiment of the present invention in cross-section. The flanged component forming method according to the third embodiment is designed to finish the flange portion F in the flange-forming die 19 into a prescribed shape. Thus, the flange-forming die 19 of this third embodiment of the present invention has a forming recess or surface 23.

If the forming recess 23 for forming a flange is formed, for example, on the pressure application surface of the flange-forming die 19, as shown in diagram (A) of FIG. 7, the pre-flanged forming portion 2 of the forming material W can be sandwiched and pressed against the punch 10. Thus, the pre-flanged forming portion 2 can be formed into a prescribed shape that corresponds to the forming recess 23. Therefore, if a concavity 24 for forming a guide portion 25 that connects the constant-velocity joint and other components of the rotation torque transmission mechanism is provided, for example, to the forming recess 23, the formed article Wa after formation will have the guide portion 25, and the ease of assembly and processability will be improved.

Various modified examples such as those described below can be used with this embodiment. In these examples, the forming recess 23 is disposed in such a flange-forming die 19, and the forming recess 23 is used to form the pre-flanged forming portion 2.

First Exemplary Modification of Third Embodiment

Figure 8:
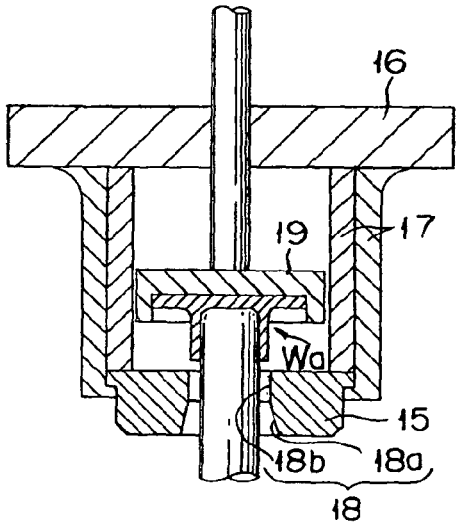
FIG. 8 is a simplified schematic diagram, in cross-section, showing the main parts of the flanged component forming device in accordance with a first exemplary modification of the third embodiment of the present invention.
Figure 9:
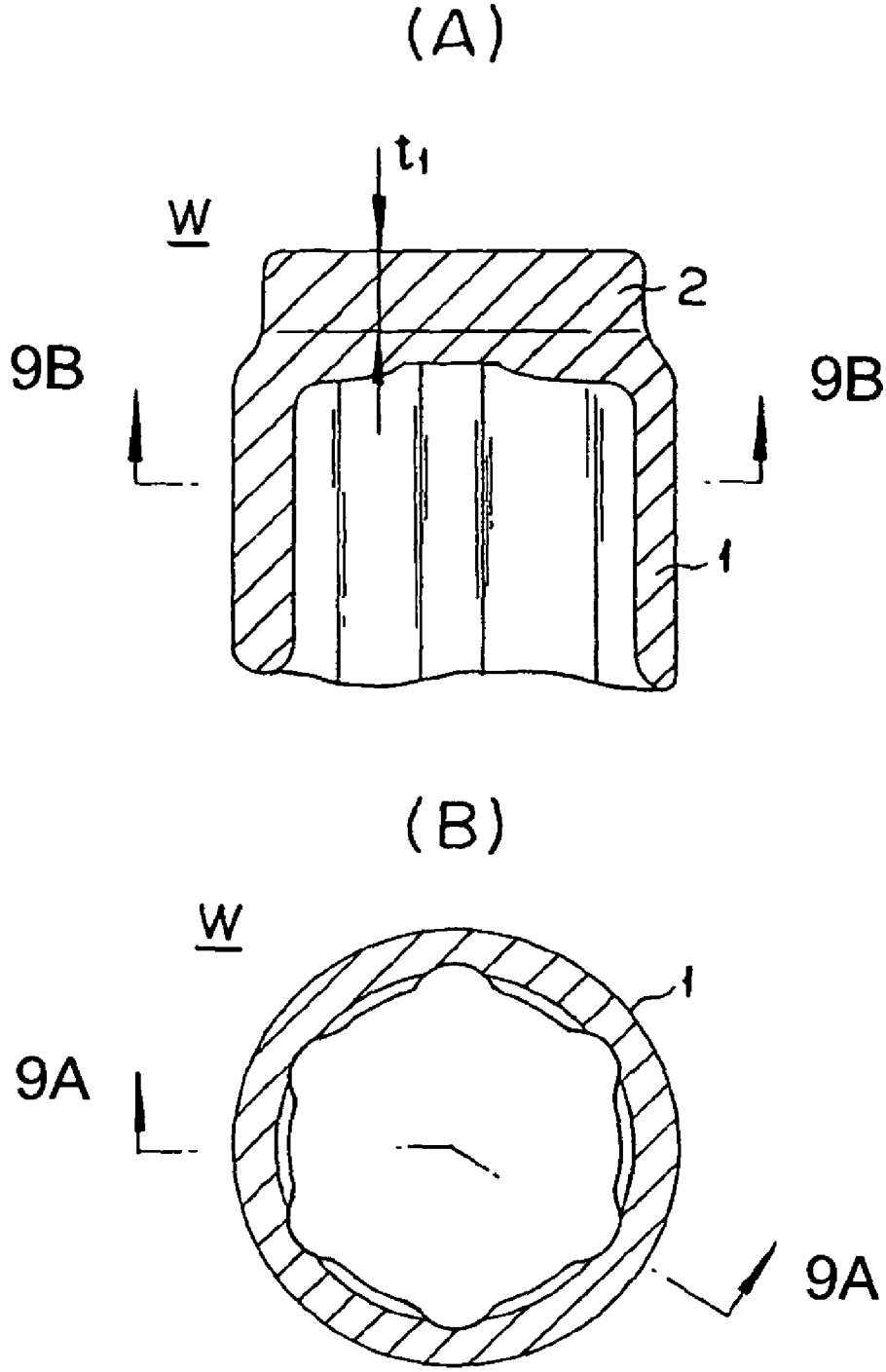
FIG. 9 is a pair of simplified schematic views of a workpiece material produced by warm forging, with view (A) of FIG. 9 being a cross-sectional view of the workpiece material as viewed along section line 9A-9A of view (B) of FIG. 9, and with view (B) of FIG. 9 being a cross-sectional view of the workpiece material as viewed along section line 9B-9B of view (A) of FIG. 9.
Figure 10:
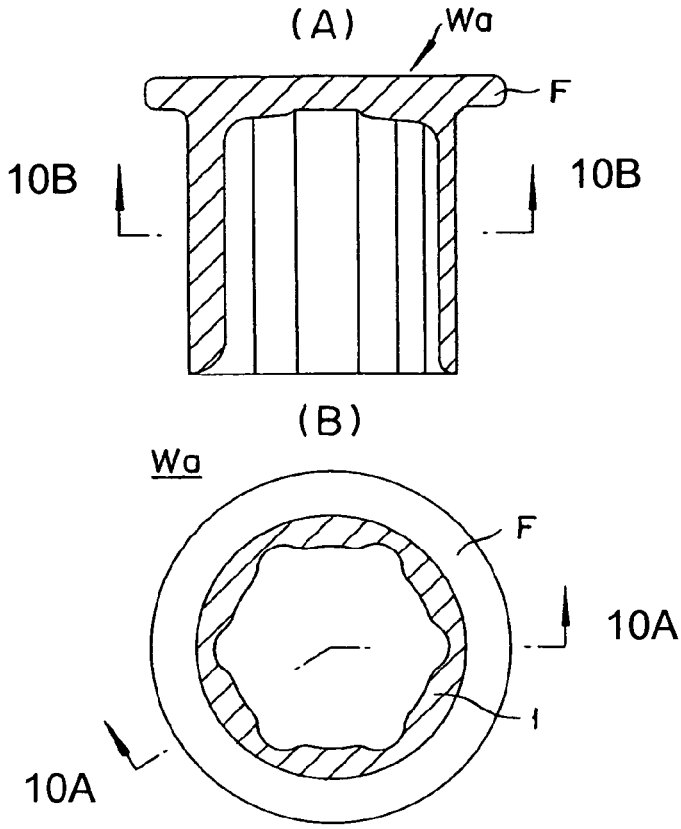
FIG. 10 is a pair of simplified schematic views of a formed article in a state following flange portion formation, with view (A) of FIG. 10 being a cross-sectional view of the formed article as viewed along section line 10A-10A of view (B) of FIG. 10, and with view (B) of FIG. 10 being a cross-sectional view of the formed article as viewed along section line 10B-10B of view (A) of FIG. 10.

Referring now to FIGS. 8 to 10, a flanged component forming method in accordance with a first exemplary modification of the third embodiment will now be explained. In view of the similarity between the prior embodiments and this modification of the third embodiment, the similar parts will be given the same reference numerals as the parts of the prior embodiments. Moreover, the descriptions of the parts and steps of this modification that are similar to the parts and steps of the prior embodiments may be omitted for the sake of brevity.

FIG. 8 is a simplified schematic diagram, in cross-section, showing the main parts of the flanged component forming device in accordance with a first exemplary modification of the third embodiment of the present invention. FIG. 9 is a pair of simplified schematic views of a workpiece material produced by warm forging, with view (A) of FIG. 9 being a cross-sectional view of the workpiece material as viewed along section line 9A-9A of view (B) of FIG. 9, and with view (B) of FIG. 9 being a cross-sectional view of the workpiece material as viewed along section line 9B-9B of view (A) of FIG. 9. FIG. 10 is a pair of simplified schematic views of a formed article in a state following flange portion formation, with view (A) of FIG. 10 being a cross-sectional view of the formed article as viewed along section line 10A-10A of view (B) of FIG. 10, and with view (B) of FIG. 10 being a cross-sectional view of the formed article as viewed along section line 10B-10B of view (A) of FIG. 10.

The formed article Wa of the present exemplary modification has the flange portion F uniformly extending in the outward radial direction from the trunk portion 1, as shown in the views (A) and (B) of FIG. 10. The forming material W is a material in which the pre-flanged forming portion 2 has a uniform prescribed thickness $t_1$ as shown in the view (A) of FIG. 9. As in the prior embodiments, the pre-flanged forming portion 2 is disposed on the upper portion of the trunk portion 1, as shown in the views (A) and (B) of FIG. 9.

When the pre-flanged forming portion 2 enters the forming recess 23 of the flange-forming die 19 after the forming material W has been or is being ironed by the sizing die 15, the outwardly protruding portion in the radial direction of the pre-flanged forming portion 2 is restricted by the forming recess 23, and the flange portion F is formed with a flat and circular, disc-like shape (discoid) as seen in FIG. 10.

Second Exemplary Modification of Third Embodiment

Figure 11:
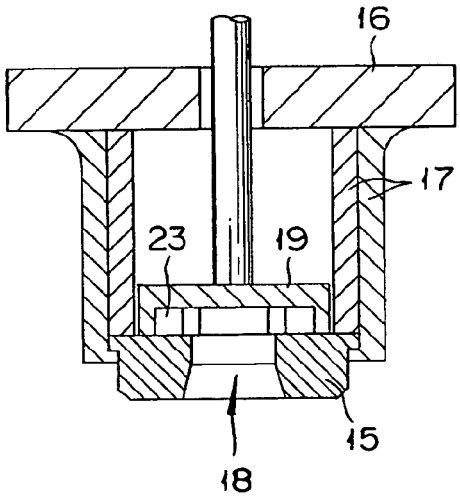
FIG. 11 is a simplified schematic diagram, in cross-section, showing the main parts of the flanged component forming device in accordance with a second exemplary modification of the third embodiment of the present invention.
Figure 12:
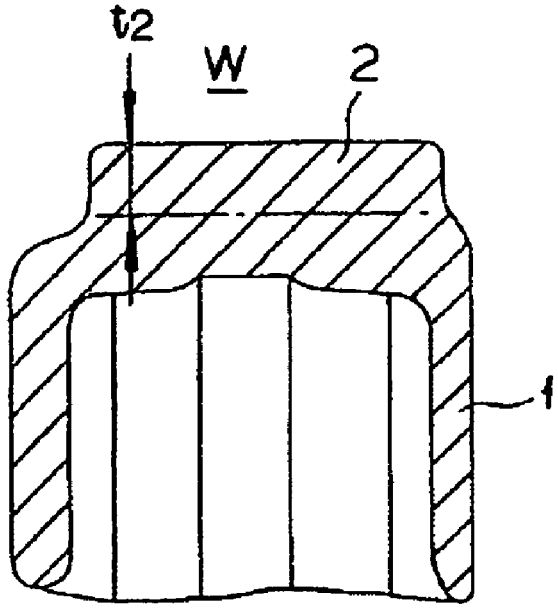
FIG. 12 is a pair of simplified schematic views of a workpiece material produced by warm forging, with view (A) of FIG. 12 being a cross-sectional view of the workpiece material as viewed along section line 12-12 of view (B) of FIG. 12, and with view (B) of FIG. 12 being a bottom plan view of the workpiece material illustrated in view (A) of FIG. 12.
Figure 12:
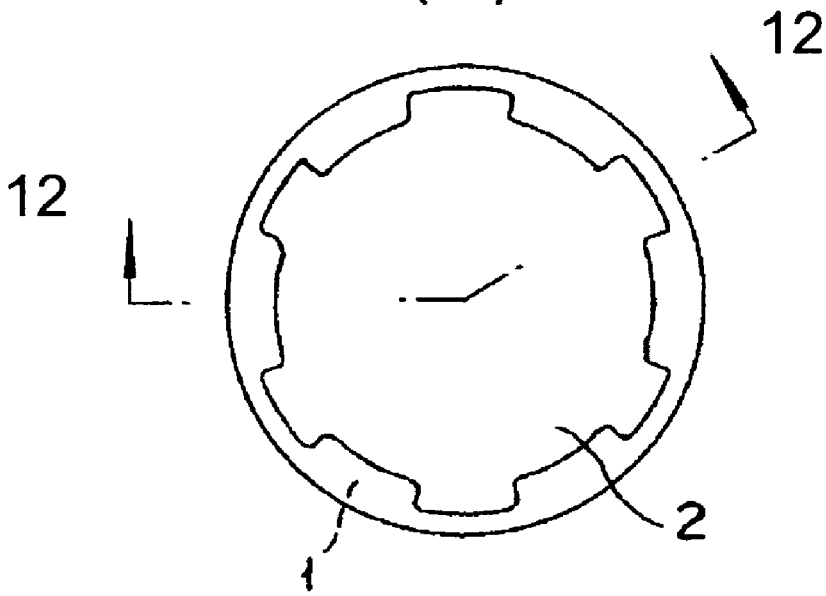
Figure 13:
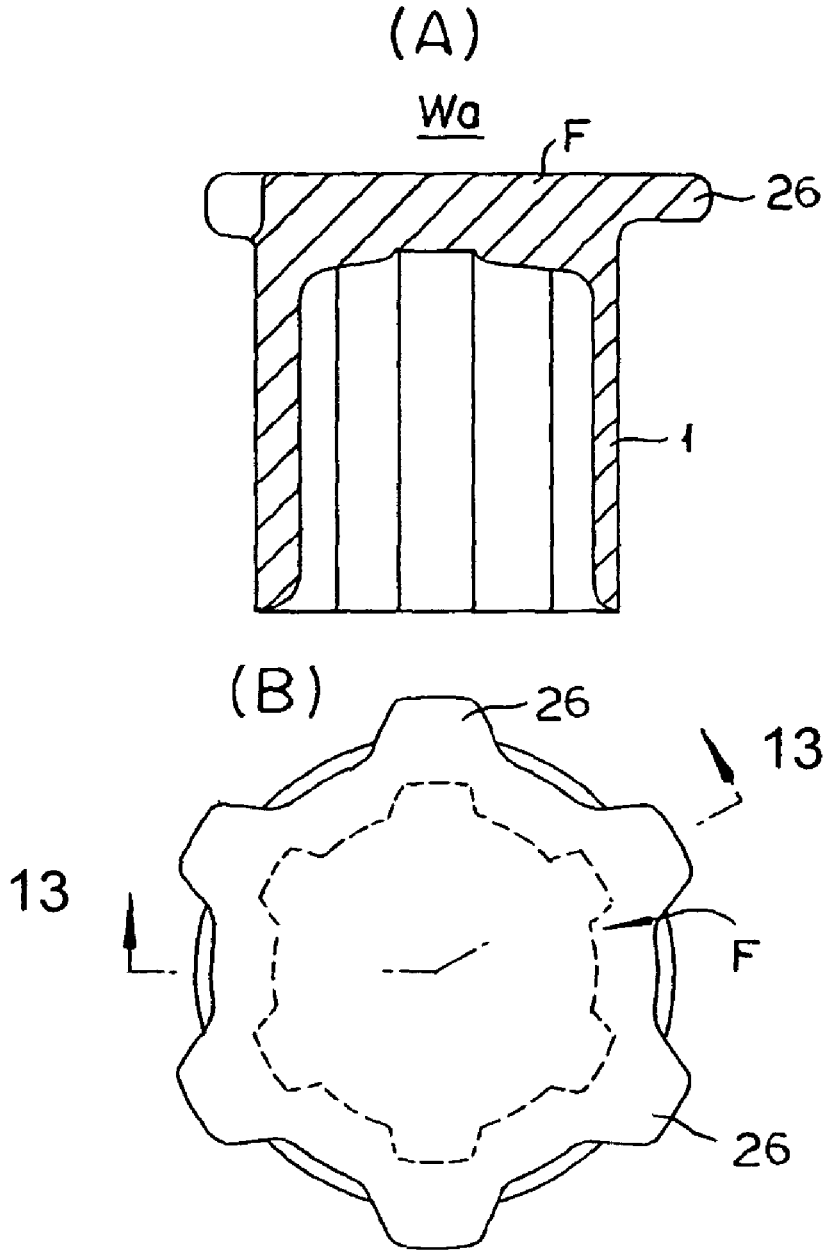
FIG. 13 is a pair of simplified schematic views of a formed article in a state following flange portion formation, with view (A) of FIG. 13 being a cross-sectional view of the formed article as viewed along section line 13-13 of view (B) of FIG. 13, and with view (B) of FIG. 13 being a top plan view of the formed article illustrated in view (A) of FIG. 13.

Referring now to FIGS. 11 to 13, a flanged component forming method in accordance with a second exemplary modification of the third embodiment will now be explained. In view of the similarity between the prior embodiments and this modification of the third embodiment, the similar parts will be given the same reference numerals as the parts of the prior embodiments. Moreover, the descriptions of the parts and steps of this modification that are similar to the parts and steps of the prior embodiments may be omitted for the sake of brevity.

FIG. 11 is a simplified schematic diagram, in cross-section, showing the main parts of the flanged component forming device in accordance with a second exemplary modification of the third embodiment of the present invention. FIG. 12 is a pair of simplified schematic views of a workpiece material produced by warm forging, with view (A) of FIG. 12 being a cross-sectional view of the workpiece material as viewed along section line 12-12 of view (B) of FIG. 12, and with view (B) of FIG. 12 being a top plan view of the workpiece material illustrated in view (A) of FIG. 12. FIG. 13 is a pair of simplified schematic views of a formed article in a state following flange portion formation, with view (A) of FIG. 13 being a cross-sectional view of the formed article as viewed along section line 13-13 of view (B) of FIG. 13, and with view (B) of FIG. 13 being a top plan view of the formed article illustrated in view (A) of FIG. 13.

The formed article Wa of the present exemplary modification has the flange portion F with a plurality of radial protrusions 26, as shown in FIG. 13. In particular, the protrusions 26 protrude from the trunk portion 1 in the radial direction. The forming material W is a material in which the pre-flanged forming portion 2 has a uniform prescribed thickness $t_2$, as shown in the views (A) and (B) of FIG. 13. As in the prior embodiments, the pre-flanged forming portion 2 is disposed on the upper portion of the trunk portion 1, as shown in the views (A) and (B) of FIG. 13.

Thus, the flange-forming die 19 is uses the forming recess 23 in which a plurality of concavities corresponding to the protrusions 26 are formed in the internal surface of the die. When the pre-flanged forming portion 2 is pressed inside the flange-forming die 19, the flange portion F is formed having the protrusions 26 corresponding to the shape of the forming recess 23.

Third Exemplary Modification of Third Embodiment

Figure 14:
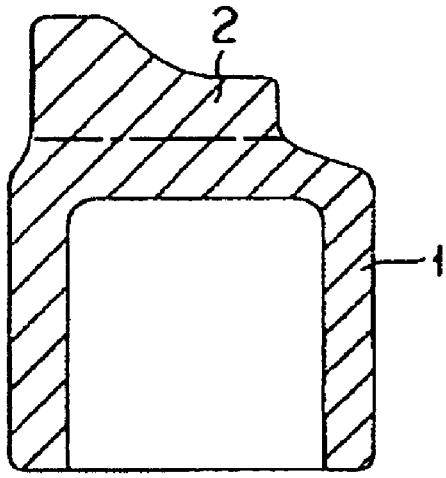
FIG. 14 is a pair of simplified schematic views of a workpiece material produced by warm forging, with view (A) of FIG. 14 being a cross-sectional view of the workpiece material as viewed along section line 14-14 of view (B) of FIG. 14, and with view (B) of FIG. 14 being a top plan view of the workpiece material illustrated in view (A) of FIG. 14.
Figure 14:
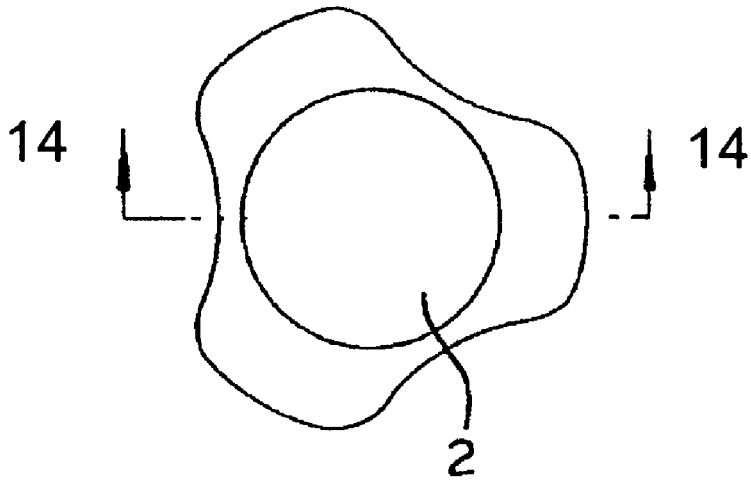
Figure 15:
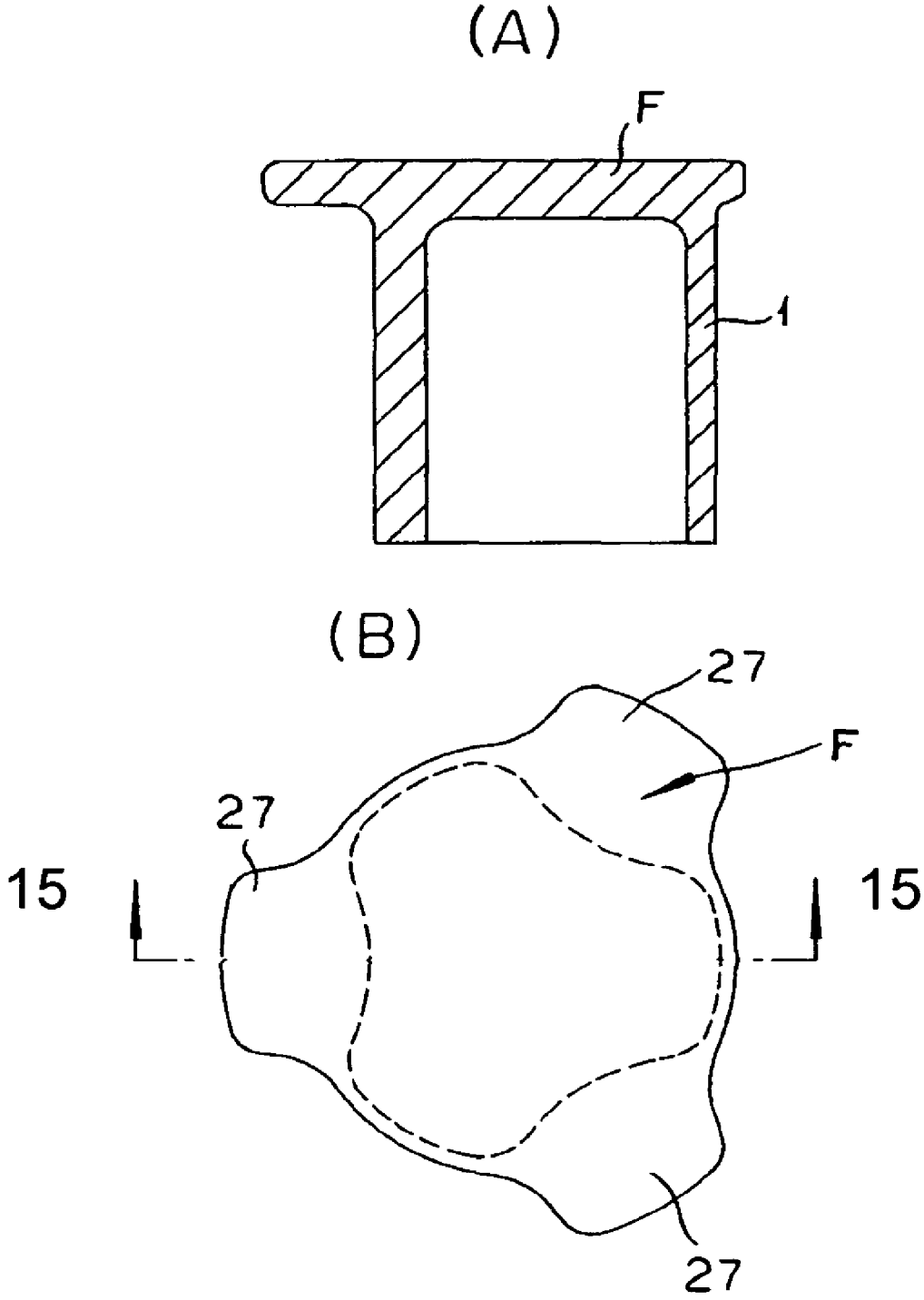
FIG. 15 is a pair of simplified schematic views of a formed article in a state following flange portion formation, with view (A) of FIG. 15 being a cross-sectional view of the formed article as viewed along section line 15-15 of view (B) of FIG. 15, and with view (B) of FIG. 15 being a top plan view of the formed article illustrated in view (A) of FIG. 15.

Referring now to FIGS. 14 to 15, a flanged component forming method in accordance with a third exemplary modification of the third embodiment will now be explained. In view of the similarity between the prior embodiments and this modification of the third embodiment, the similar parts will be given the same reference numerals as the parts of the prior embodiments. Moreover, the descriptions of the parts and steps of this modification that are similar to the parts and steps of the prior embodiments may be omitted for the sake of brevity.

FIG. 14 is a pair of simplified schematic views of a workpiece material produced by warm forging, with view (A) of FIG. 14 being a cross-sectional view of the workpiece material as viewed along section line 14-14 of view (B) of FIG. 14, and with view (B) of FIG. 14 being a top plan view of the workpiece material illustrated in view (A) of FIG. 14. FIG. 15 is a pair of simplified schematic views of a formed article in a state following flange portion formation, with view (A) of FIG. 15 being a cross-sectional view of the formed article as viewed along section line 15-15 of view (B) of FIG. 15, and with view (B) of FIG. 15 being a top plan view of the formed article illustrated in view (A) of FIG. 15.

The formed article Wa of the present exemplary modification is one in which the flange-forming die 19 is used that is substantially the same as the flange-forming die used in the second exemplary modification described above. Thus, the flange portion F is formed a shape in which three protrusions 27 protrude from the trunk portion 1. The forming material W is a material in which the pre-flanged forming portion 2 has excess material, as shown in diagrams (A) and (B) of FIG. 14 that is in a portion that is used to form the flange portion F on the upper portion of the trunk portion 1 as shown in diagrams (A) and (B) of FIG. 15.

When the pre-flanged forming portion 2 is pressed inside the flange-forming die 19 in such a configuration, a relatively large flange portion F is formed from the excess material, and the machining allowance can therefore be reduced when the formed article is to be machined. The portion having excess material disposed in the pre-flanged forming portion 2 is not necessarily required to be disposed in uniform positions in the peripheral direction, and an irregularly shaped flange portion F can be formed by disposing the excess material in a non-uniform manner.

Fourth Embodiment

In the embodiment described above, an irregularly shaped flange portion F is formed by disposing excess material in the pre-flanged forming portion 2, but an irregularly shaped flange portion F can also be formed by ironing the pre-flanged forming portion 2, forming the flange portion F using the flange-forming die 19, and trimming the external periphery of the flange portion F. Machining, plastic working, and other methods can be used as the trimming method.

Such a configuration allows an irregularly shaped flange portion F to be rapidly formed in a simple manner.

Fifth Embodiment

Figure 16:
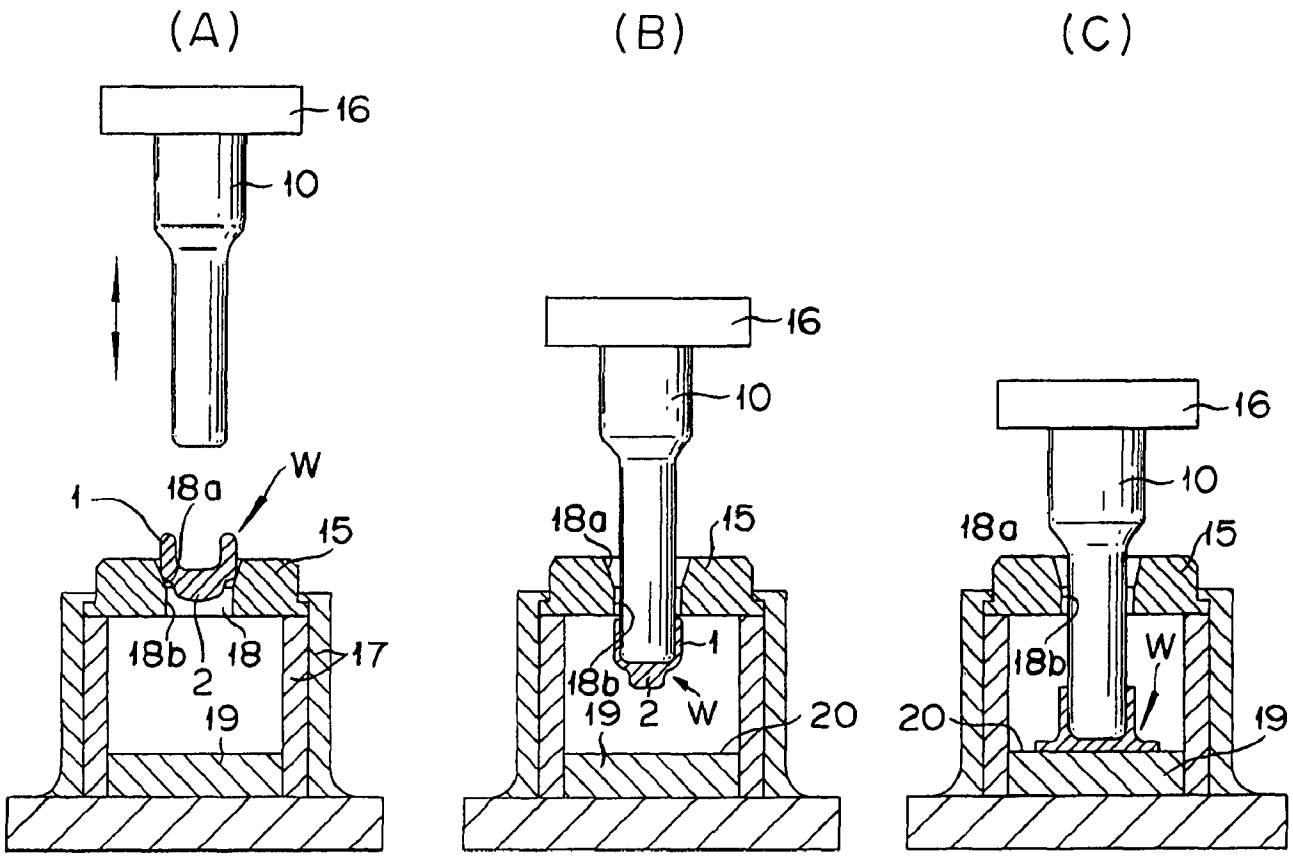
FIG. 16 is a series of simplified schematic diagrams (A) to (C), in cross-section, showing a sequence of steps in a flanged component forming method in accordance with a fifth embodiment of the present invention.

Referring now to FIG. 16, a flanged component forming method in accordance with a fifth embodiment will now be explained. In view of the similarity between the fifth embodiment and the prior embodiments, the parts of the fifth embodiment that are similar to the parts of the prior embodiments will be given the same reference numerals as the parts of the prior embodiments. Moreover, the descriptions of the parts and steps of the fifth embodiment that are similar to the parts and steps of the prior embodiments may be omitted for the sake of brevity. Diagrams (A) to (C) of FIG. 16 schematically illustrate the flanged component forming method according to the fifth embodiment of the present invention in cross-section.

In the prior embodiments described above, the forming material W is held by the punch 10, and the forming material W held on the punch 10 is ironed by the sizing die 15, but a reverse arrangement is also possible. In particular, the forming material W can be held by the die 15 and the forming material can be ironed by the cooperative work of the die 15 and punch 10. In other words, the first and second dies of the embodiment described above can be used in reverse to carry out the forming procedure.

The flanged component forming device of this present embodiment has the sizing die 15 holding the forming material W, as shown in diagram (A) of FIG. 16. The punch 10 irons the forming material W by cooperatively working with the sizing die 15 to size the internal and external surfaces of the trunk portion 1, as shown in diagram (B) of FIG. 16. The flange-forming die 19 forms the flange portion F by sandwiching and pressing the pre-flanged forming portion 2 between the punch 10 the surface 20 of the flange-forming die 19, as shown in diagram (C) of FIG. 16.

The punch 10 is a columnar body that is mounted on the press ram 16, while the sizing die 15 is disposed in a fixed position. The forming material W is held in the central opening 18 of the sizing die 15. As in the first embodiment, the opening 18 has a configuration in which the substantially lower half has the tapered portion 18*a*, and the substantially upper half has the cylindrical portion 18*b*. The forming material W is held by the tapered portion 18*a*, which is the upper half of the opening 18.

Therefore, the forming material W is set in the lower portion of the sizing die 15, as shown in diagram (A) of FIG. 16. When the press ram 16 is lowered, the forming material W is ironed by the tapered portion 18*a* and the cylindrical portion 18*b* of the sizing die 15 and the punch 10, as shown in diagram (B) of FIG. 16. Thus, the trunk portion 1 of the forming material W is sized to a prescribed outside diameter.

Furthermore, when the press ram 16 is lowered, the pressing surface 20, which is the upper surface of the flange-forming die 19, forms the pre-flanged forming portion 2 of the forming material W into a flange portion F having a prescribed thickness, as shown in diagram (C) of FIG. 16.

In the present embodiment as well, the sizing of the forming material W, the forming of tracks or grooves and the gauge guide surface, and the forming of a flange can be performed in a single press operation in the same manner as in the prior embodiment described above.

Sixth Embodiment

Figure 17:
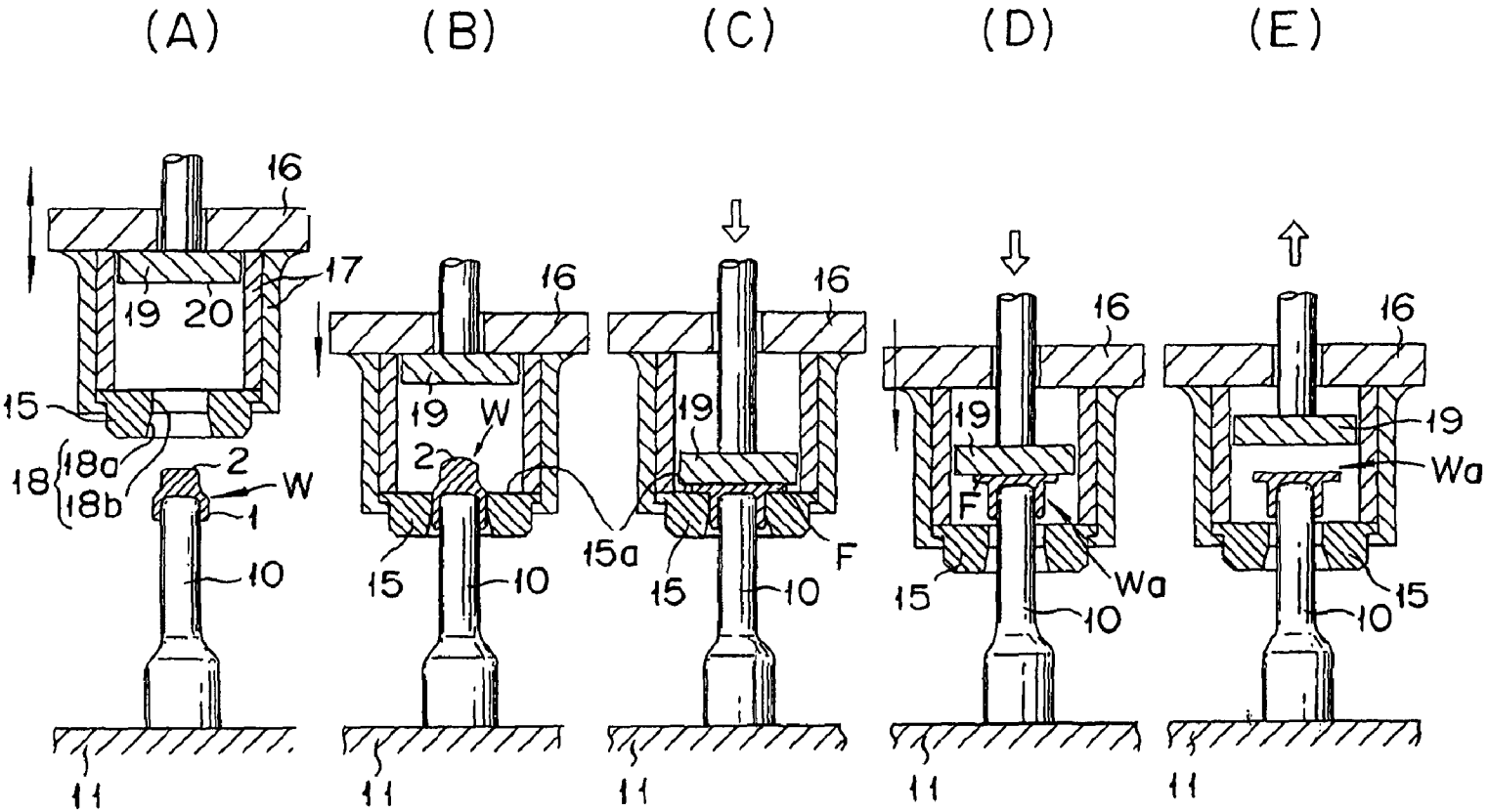
FIG. 17 is a series of simplified schematic diagrams (A) to (E), in cross-section, showing a sequence of steps in a flanged component forming method in accordance with a sixth embodiment of the present invention, wherein diagram (A) of FIG. 17 shows a set state of the forming material, diagram (B) of FIG. 17 shows a temporarily stopped state in the early stage of the sizing step, diagram (C) of FIG. 17 shows a flange-forming state in a temporarily stopped state, diagram (D) of FIG. 17 shows a state in which sizing has been completed, and diagram (E) of FIG. 17 shows a state in which the formed article can be ejected.

Referring now to FIG. 17, a flanged component forming method in accordance with a sixth embodiment will now be explained. In view of the similarity between the sixth embodiment and the prior embodiments, the parts of the sixth embodiment that are similar to the parts of the prior embodiments will be given the same reference numerals as the parts of the prior embodiments. Moreover, the descriptions of the parts and steps of the sixth embodiment that are similar to the parts and steps of the prior embodiments may be omitted for the sake of brevity. Diagrams (A) to (C) of FIG. 17 schematically illustrate the flanged component forming method according to the sixth embodiment of the present invention in cross-section.

Diagram (A) of FIG. 17 shows a set state of the forming material, diagram (B) of FIG. 17 shows a temporarily stopped state in the early stage of the sizing step. Diagram (C) of FIG. 17 shows a flange-forming state in a temporarily stopped state. Diagram (D) of FIG. 17 shows a state in which sizing has been completed. Diagram (E) of FIG. 17 shows a state in which the formed article can be ejected.

In the embodiments described above, since the entire forming material W is sized and the pre-flanged forming portion 2 is thereafter simply sandwiched and pressed against the punch 10 and compressed using the flange-forming die 19 to form the flange portion F, the pre-flanged forming portion 2 of the forming material W is sandwiched and pressed while supported only by the punch 10. For this reason, the corners that reach from the internal surface of the pre-flanged forming portion 2 to the internal surface of the trunk portion 1 bulge outward. Thus, cavities due to so-called shrink marks are produced, the entire forming material W moves in the forming direction from a midway point in the process in which the flange portion F is being formed, and the forming precision is reduced. Furthermore, the forming material W cannot be finished into a flat, well-formed flange portion F having a surface orthogonal to the axis, and the pre-flanged forming portion 2 having considerable volume may be required in order to obtain the desired outside diameter.

For this reason, in the present embodiment, the sizing die 15 is temporarily stopped in a state in which the upper portion of the trunk portion 1 of the forming material W has been sized, the upper portion of the trunk portion 1 of the forming material W is held by the sizing die 15 from the external periphery, the movement of the forming material W is restricted, and the pre-flanged forming portion 2 is sandwiched and pressed by the flange-forming die 19 in this state and compressed to form a flange portion F.

Following is a more detailed description. First, the forming material W is set on the upper portion of the punch 10, the press ram 16 is lowered, a first sizing is performed to a prescribed length in the axial direction, and the process is then stopped, as shown in diagram (A) of FIG. 17. The forming material W is ironed by the tapered portion 18*a* and the cylindrical portion 18*b* of the sizing die 15, as shown in diagram (B) of FIG. 17, and a prescribed length in the axial direction is sized to a prescribed outside diameter.

The stop position of the sizing die 15 is preferably a position at which the distal end of the punch 10 and the back surface of the sizing die 15 are aligned. In this position, the flange portion F can be received by the punch 10, and also by the sizing die 15 during flange portion formation, and the flange portion F can be formed using the flat back surface 15*a* of the sizing die 15. Therefore, the occurrence of cavities produced by shrinkage can be prevented, the flange portion F can be made flatter, and the precision of the formed article Wa can be further improved.

The press ram 16 is then lowered further, as shown in diagram (D) of FIG. 17, and the remaining portion of the forming material W is subjected to a second sizing. The second sizing transfers the shape of the concave grooves 13 and the protruding splines 12 of the punch 10 to the internal surface of the trunk portion 1. Thus, the formed article Wa is obtained in which the tracks or grooves and the gauge guide surface are formed. Ironing is thereby performed in the axial direction across the entire length of the trunk portion 1 of the forming material W, and very high degree of precision can be achieved across the entire trunk portion 1.

In addition to the effects achieved in the embodiments described above, the present embodiment allows the shape of the internal surface of the formed trunk portion 1 to remain unchanged, the required precision to be preserved, and very high degree of precision to be achieved across the entire trunk portion 1. This is because the process is stopped after the first sizing, and the second sizing is performed to thereby size the forming material W, form the tracks or grooves and the gauge guide surface, and form the flange portion in a single press operation.

Lastly, when the flange-forming die 19 is raised and the flange-forming die 19 is separated from the formed article Wa on the punch 10, as shown in diagram (E) of FIG. 17, the formed article Wa can be removed from the die by using an ejection mechanism (not shown) or the like. The flange-forming die 19 can be raised immediately after the formation of the flange portion F or simultaneous to the second sizing.

Seventh Embodiment

Figure 18:
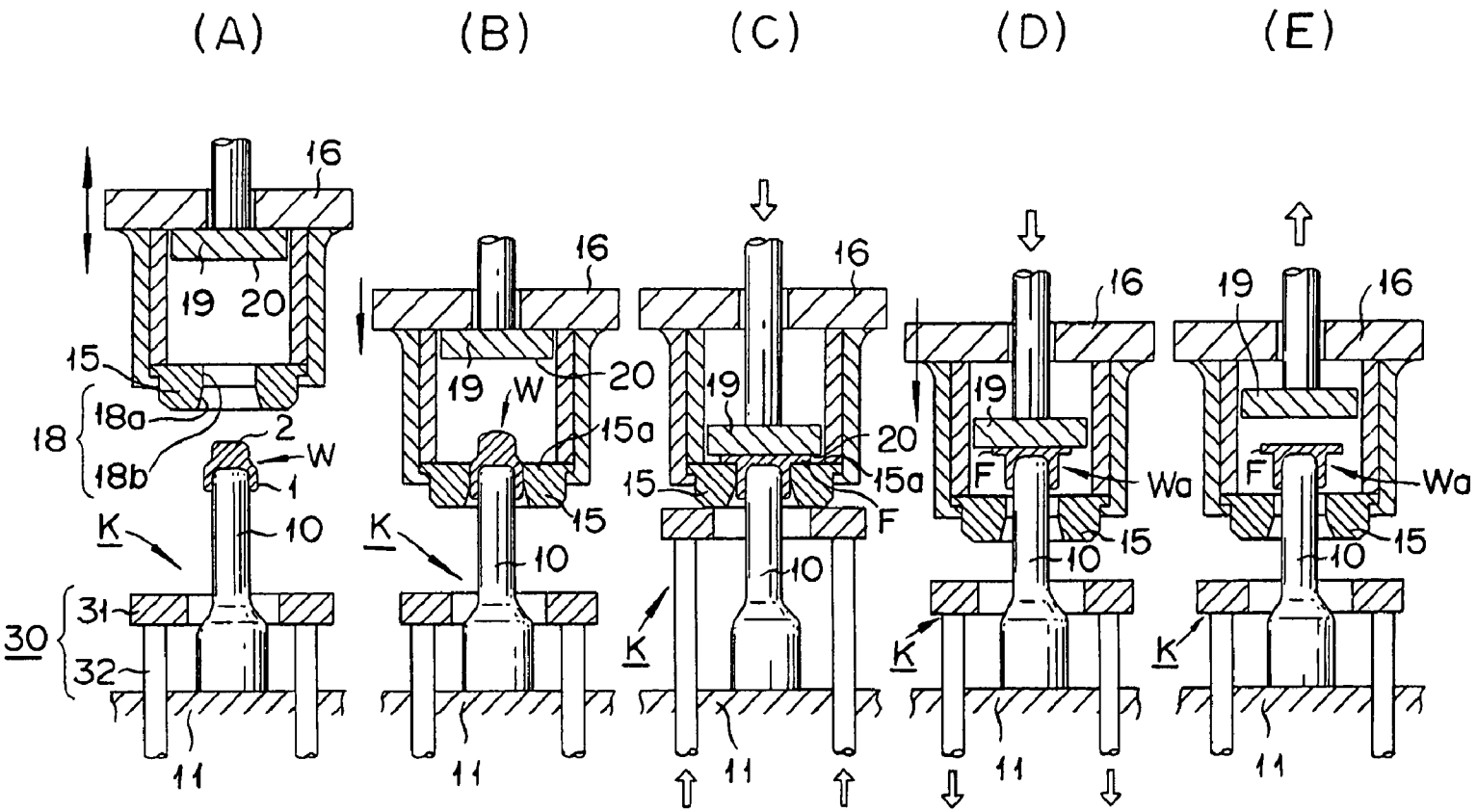
FIG. 18 is a series of simplified schematic diagrams (A) to (E), in cross-section, showing a sequence of steps in a flanged component forming method in accordance with a seventh embodiment of the present invention.

Referring now to FIG. 18, a flanged component forming method in accordance with a seventh embodiment will now be explained. In view of the similarity between the seventh embodiment and the prior embodiments, the parts of the seventh embodiment that are similar to the parts of the prior embodiments will be given the same reference numerals as the parts of the prior embodiments. Moreover, the descriptions of the parts and steps of the seventh embodiment that are similar to the parts and steps of the prior embodiments may be omitted for the sake of brevity. Diagrams (A) to (E) of FIG. 18 schematically illustrate the flanged component forming method according to the seventh embodiment of the present invention in cross-section.

In the flanged component forming method described above, the forming material W is held only by the sizing die 15 from the external periphery during flange portion formation. Therefore, when pressing force is applied by the flange-forming die 19 to the forming material W, the sizing die 15 may occasionally cause positional displacement. Since this positional displacement tends to negatively affect the formation of the flange portion F, the position of the sizing die 15 is fixed in the present embodiment by using a fixing device K.

The fixing device K can be any type of fixing device as long as the sizing die 15 can be supported in a fixed position. The fixing device K preferably includes a die cushion 30.

The die cushion 30 comprises a cushion pad 31 that is coaxially disposed about the periphery of the punch 10, and a plurality of cushion pins 32 for supporting the cushion pad 31 while the cushion pad 31 can move up and down. When the sizing die 15 is at the stop position described above, the cushion pad 31 moves upward to support the sizing die 15 from below, as shown in diagram (C) of FIG. 18. The sizing die 15 holds the initial stop position horizontally even if the forming material W is pressed by the flange-forming die 19.

The fixing device K can further include a hydraulic mechanism, a spring, a gas cushion, or other device used in closed die sets. Also, a stopper member (not shown) can be disposed laterally of the punch 10, assume a protruding position when the sizing die 15 is stopped, and support the sizing die 15 from below.

In this forming method as well, the forming material W is set on the upper portion of the punch 10, as shown in diagram (A) of FIG. 18, in the same manner as in the sixth embodiment described above. Thus, the press ram 16 is lowered, as shown in diagram (B) of FIG. 18. A portion of the trunk portion 1 of the forming material W is ironed by the sizing die 15. The first sizing is performed and the process is then stopped. The external surface of a portion of the trunk portion 1 of the forming material W is thereby sized to a prescribed outside diameter.

Next, the cushion pad 31 is raised by the cushion pins 32 toward the stopped sizing die 15 to support the sizing die 15 from below, as shown in diagram (C) of FIG. 18. In the supported state, the flange-forming die 19 is lowered, the forming material W is pressed, and the flange portion F is formed. In this configuration, the sizing die 15 is constantly held by the die cushion 30 during the processing performed by the flange-forming die 19, and the sizing die 15, which supports the periphery of the trunk portion of the forming material W, does not become displaced. Forming can therefore be smoothly performed and the precision of the formed article Wa can be improved. When the pre-flanged forming portion 2 of the forming material W is pressed by the pressing surface 20, which is the lower surface of the flange-forming die 19, the material is pressed and deformed using the back surface 15*a* (see diagram (C) of FIG. 18) of the sizing die 15, and a flat flange portion F can be formed to a prescribed thickness.

After the flange portion F has been formed, the press ram 16 is lowered again and the trunk portion of the forming material W is subjected to a second sizing by ironing using the sizing die 15, as shown in diagram (D) of FIG. 18. The entire trunk portion of the forming material W is thereby sized and finished to a prescribed outside diameter, and the tracks or grooves and the gauge guide surface are formed on the internal surface.

Lastly, the flange-forming die 19 is raised and the formed article Wa is removed from the die by using an ejection mechanism (not shown), as shown in diagram (E) of FIG. 18.

In the present embodiment as well, the forming material W can be sized, and tracks or grooves and a gauge guide surface can be formed in a single press operation in the same manner as in the first embodiment described above.

Eighth Embodiment

Figure 19:
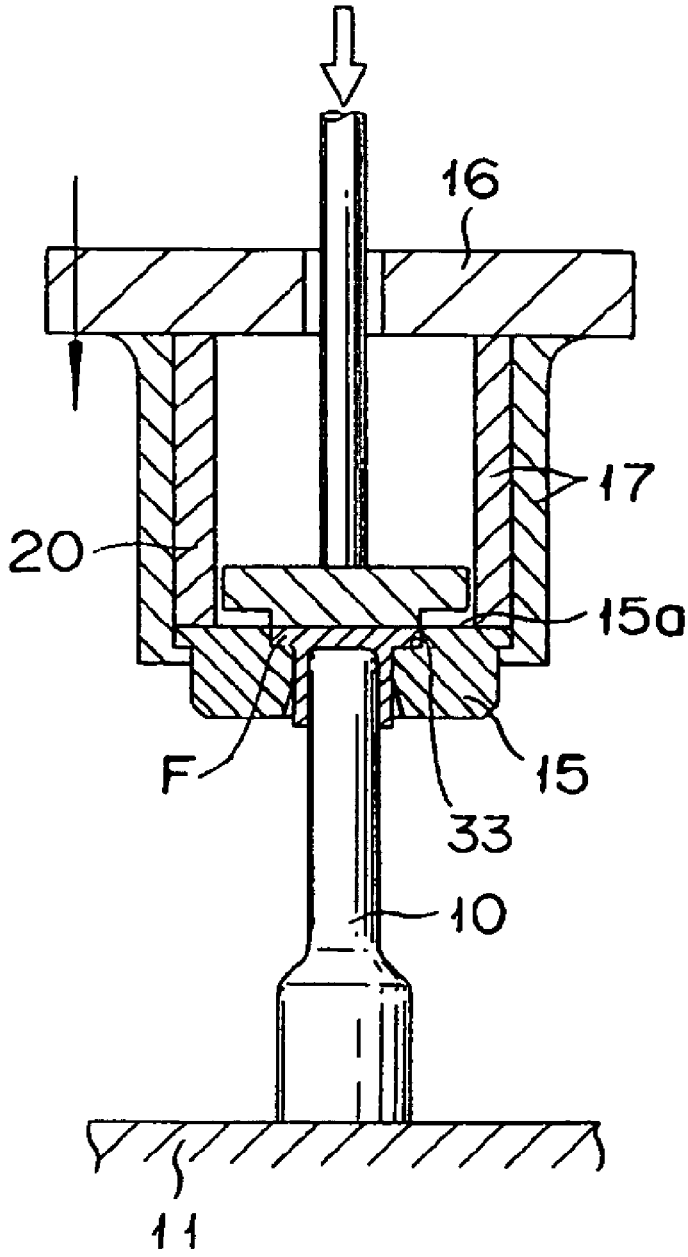
FIG. 19 is a simplified schematic diagram, in cross-section, showing the main parts of a forming device in accordance with an eighth embodiment of the present invention.

Referring now to FIG. 19, a flanged component forming device in accordance with an eighth embodiment will now be explained. In view of the similarity between the eighth embodiment and the prior embodiments, the parts of the eighth embodiment that are similar to the parts of the prior embodiments will be given the same reference numerals as the parts of the prior embodiments. Moreover, the descriptions of the parts and steps of the eighth embodiment that are similar to the parts and steps of the prior embodiments may be omitted for the sake of brevity.

In this flanged component forming device, the sizing die 15 is provided with a concavity 33 for forming the flange portion F. In particular, the concavity 33 is formed in a back surface 15*a* of the sizing die 15 where the pressure is applied by the press ram 16 to the forming material W. Thus, the flange portion F is finished into a prescribed shape inside the concavity 33.

If the pre-flanged forming portion 2 is sandwiched and pressed between the flange-forming die 19 and the punch 10 by using the sizing die 15 that has the concavity 33, as shown in FIG. 19. The pre-flanged forming portion 2 is pressed and formed in the closed area. Therefore, the elongation of the pre-flanged forming portion 2 is restricted by the concavity 33, the pre-flanged forming portion 2 is formed into a specifically shaped flange portion F that corresponds to the concavity 33, and a very high degree of precision flange portion F can be formed.

When the concavity 33 is disposed in the sizing die 15 and the pre-flanged forming portion 2 is formed, various modified examples such as those shown in FIG. 13 to 15 described above can be formed depending on the concavity 33.

Ninth Embodiment

Figure 20:
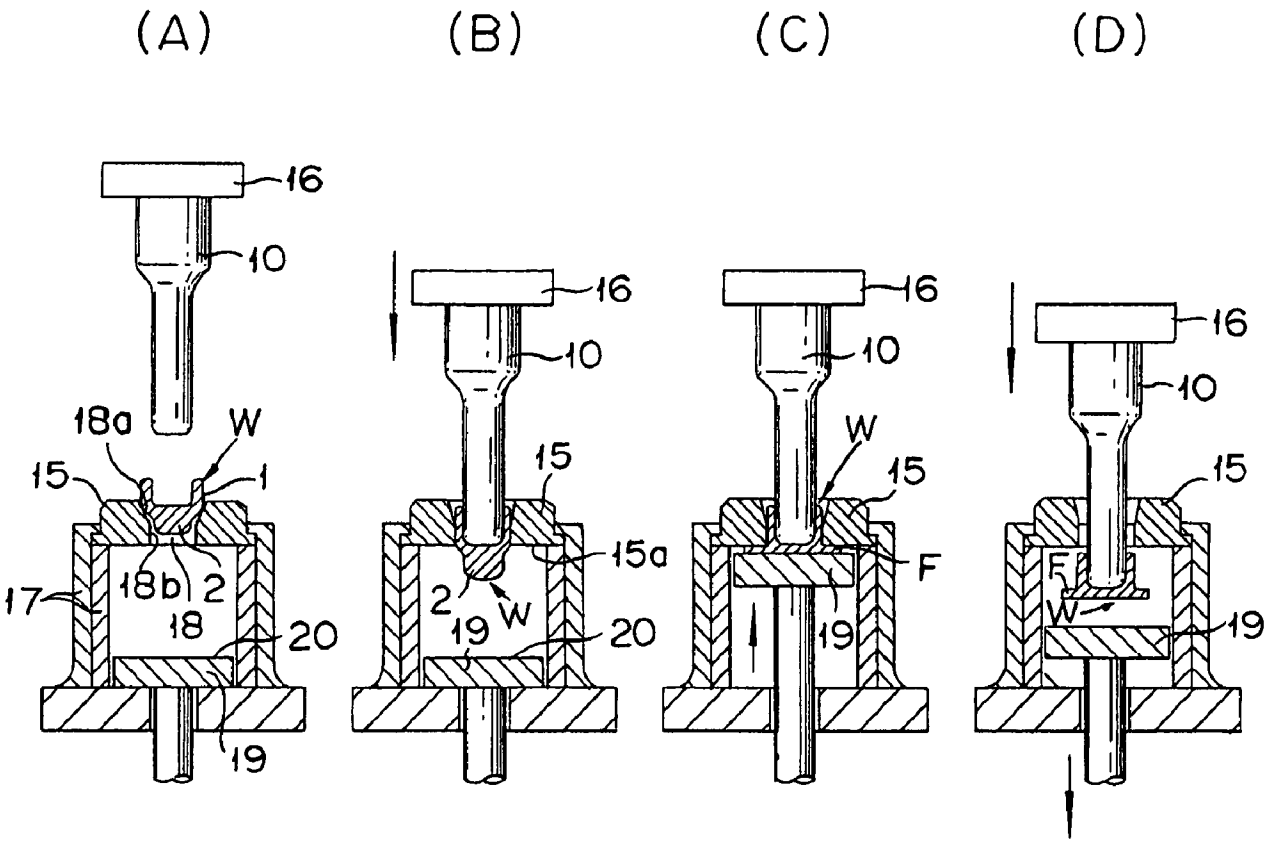
FIG. 20 is a series of simplified schematic diagrams (A) to (D), in cross-section, showing a sequence of steps in a flanged component forming method in accordance with a ninth embodiment of the present invention.

Referring now to FIG. 20, a flanged component forming method in accordance with a ninth embodiment will now be explained. In view of the similarity between the ninth embodiment and the prior embodiments, the parts of the ninth embodiment that are similar to the parts of the prior embodiments will be given the same reference numerals as the parts of the prior embodiments. Moreover, the descriptions of the parts and steps of the ninth embodiment that are similar to the parts and steps of the prior embodiments may be omitted for the sake of brevity. Diagrams (A) to (E) of FIG. 20 schematically illustrate the flanged component forming method according to the seventh embodiment of the present invention in cross-section.

In the sixth to eighth embodiments described above, the forming material W is held on the punch 10, and first and second sizing processes are performed on the forming material W while being held on the punch 10 by the sizing die 15. However, a reverse arrangement is also possible; namely, the forming material W can be held by the sizing die 15, and the forming material W can be ironed by the cooperative work of the sizing die 15 and the punch 10.

When the forming material W is set on the lower portion of the sizing die 15 and the press ram 16 is lowered, as shown in diagram (A) of FIG. 20, the forming material W is ironed by the tapered portion 18*a* and the cylindrical portion 18*b* of the sizing die 15 and the punch 10 to be sized to a prescribed outside diameter, as shown in diagram (B) of FIG. 20. This sizing is a first sizing whereby only a portion along the axial direction of the internal and external surfaces of the trunk portion 1 is ironed along the axial direction of the forming material W, and the forming material W is in a state in which the pre-flanged forming portion 2 is protruding from the back surface 15*a* of the sizing die 15.

After the first sizing is completed, the processing operation of the punch 10 is temporarily stopped; the flange-forming die 19 is raised by driving means (not shown) during the stoppage, as shown in diagram (C) of FIG. 20; the pre-flanged forming portion 2 is sandwiched and pressed against the punch 10; and the pressing surface 20, which is the back surface of the flange-forming die 19, forms the pre-flanged forming portion 2 of the forming material W into a flange portion F having a prescribed thickness.

When the formation of the flange portion F is completed, the flange-forming die 19 is lowered by the driving device (not shown), as shown in diagram (D) of FIG. 20, and the punch 10 is lowered by the press ram 16 to perform a second sizing.

In the present embodiment as well, the forming material W can be sized, the tracks or grooves and the gauge guide surface can be formed, and the flange portion can be formed in a single press operation in the same manner as in the first embodiment described above.

Figure 21:
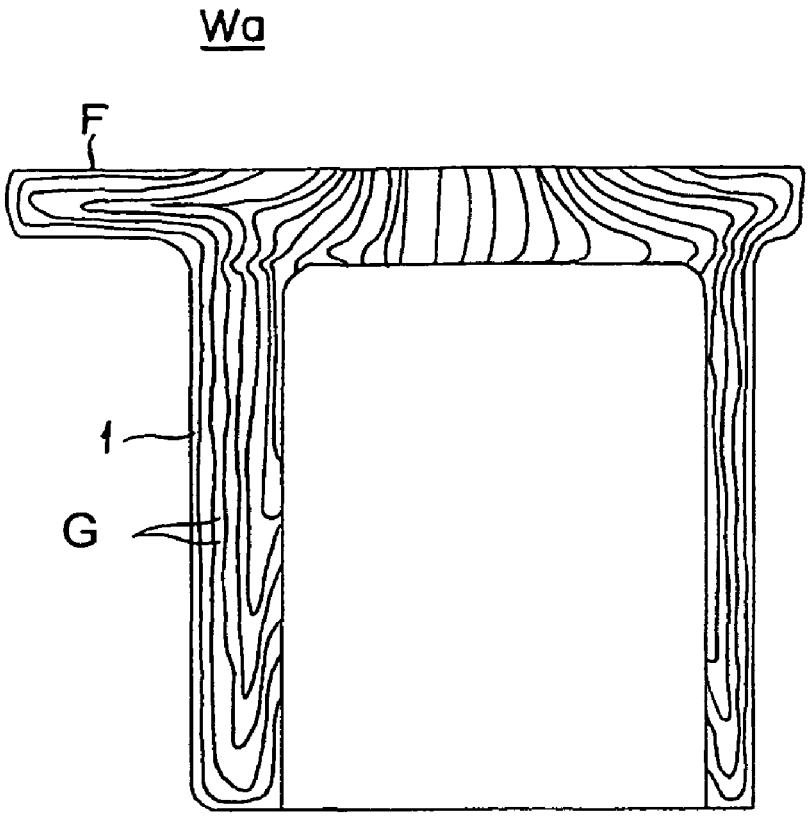
FIG. 21 is a simplified schematic cross-sectional view of a formed article showing the grain flow of the formed article that was formed in accordance with any one of the first to ninth embodiments of the present invention.

As seen in FIG. 21, the formed article Wa obtained in the first to ninth embodiments described above is produced substantially without the use of mechanical machining and welding such that a continuous grain flow G is formed in the metal material of the formed article Wa. The formed article Wa is formed by ironing, sizing, and sandwiching and pressing, and a flanged housing member having a continuous grain flow from the flange portion F to the trunk portion 1 can be obtained. In other words, the internal and external surfaces of the forming material W, in which the pre-flanged forming portion 2 is disposed at one end of the trunk portion 2, are sized by ironing to produce a high-strength formed article in which the grain flow G is continuous from the trunk portion 1 to the flange portion F with the closure being formed by sandwiching and pressing the pre-flanged forming portion 2.

As used herein, the term "grain flow" is a continuous line that extends from one side surface of the flange portion F into the interior of the flange portion F toward the protruding direction of the flange portion F, curves and returns inside the flange portion F, and then arrives at the trunk portion 1, as shown in FIG. 21. In other words, the continuous grain flow G is at least partially defined by a continuous line that extends outwardly from a first side surface of the flange portion F at the trunk portion 1 into the flange portion F, curves back inwardly in the flange portion F. The continuous grain flow G further extends from inside the flange portion F and ends at the internal surface of the trunk portion 1 as shown in FIG. 21.

Therefore, the formed article Wa has the continuous grain flow G that is not severed at a midway point and has excellent strength with respect to transmitting torque. Therefore, the formed article Wa can be made thinner and more lightweight, and costs can also be reduced. In particular, since the grain flow is continuous from the flange portion F to the trunk portion 1, the strength of the flange portion F in which stress is most likely concentrated can be increased.

In accordance with the above embodiments of the present invention, sufficient precision can be achieved overall without machining the formed article Wa (flanged housing member) because the trunk portion 1 of the forming material W is ironed by the first and second dies, at least the internal surface is sized, and the pre-flanged forming portion is sandwiched and pressed between the first die and the flange-forming die to form the flange portion. Also, since the formed article Wa (flanged housing member) can be formed by cold and warm forging without the use of hot forging, the formation of a decarburized layer can be reduced and a formed article can be obtained that has high degree of precision and does not tend to have reduced strength. Furthermore, since a flange or cover member does not need to be mounted after forming, the number of components can be reduced, lead time can be shortened, and manufacturability can be made advantageous from the aspect of costs.

Moreover, as described above, if the process is temporarily stopped in a state in which the trunk portion of the forming material has been sized to a prescribed length and the formation of the flange is started during this stoppage, a flange can be formed in a state in which the forming material is held in the second die, the back surface of the second die can be used to form the flange, and a flange can be formed in a simple manner with very good precision and no shrinkage in the forming material.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. In the embodiments described above, for example, a substantially flat flange portion F is formed at the end of the trunk portion 1, but other possible options include those in which a shaft protrudes from the flange portion F as an outer ring of a constant-velocity joint. This type of formed article Wa can be obtained even in the case of a so-called housing with a shaft. However, in such a case, the shaft must be prevented from being pressed by the flange-forming die. The forming material W of the embodiments is used to form the outer ring of a constant-velocity joint, but no limit is imposed thereby, and any material can be used as long as the forming material W is one having the trunk portion 1 and the pre-flanged forming portion 2 that is disposed so as to close one end of the trunk portion 1.

Thus, the foregoing descriptions of the embodiments according to the present invention are provided for illustration only, and not for the purpose of limiting the invention as defined by the appended claims and their equivalents.

What is claimed is:

1. A flanged component forming method for forming a flanged housing member comprising:

holding a forming material having a pre-flanged forming portion that is disposed at one end of a trunk portion of the forming material;

sizing an initial portion of the trunk portion using a first die having an external forming surface and a second die having an internal forming surface, the second die cooperating with the first die to iron the initial portion of the trunk portion to a prescribed length;

sandwiching and pressing the pre-flanged forming portion between the first die and a flange-forming die to form a flange portion on the one end of the trunk portion; and sizing a remainder portion of the trunk portion after performing the sandwiching and pressing of the pre-flanged forming portion.

2. The flanged component forming method according to claim 1, wherein the sandwiching and pressing of the pre-flanged forming portion are performed after the sizing of the initial portion of the trunk portion.

3. The flanged component forming method according to claim 1, wherein the sandwiching and pressing of the pre-flanged forming portion are performed during relative movement between the second die and the forming material immediately after the sizing of the initial portion of the trunk portion.

4. The flanged component forming method according to claim 1, wherein the sandwiching and pressing of the pre-flanged forming portion are performed during the sizing of the initial portion of the trunk portion.

5. The flanged component forming method according to claim 1, wherein the sandwiching and pressing of the pre-flanged forming portion with the flange-forming die is performed when a back surface of the second die that faces the flange-forming die is aligned with a distal end of the first die.

6. The flanged component forming method according to claim 5, wherein the sandwiching and pressing of the pre-flanged forming portion is performed in a stopped state in which the second die is supported by a fixing device.

7. The flanged component forming method according to claim 6, wherein the holding of the forming material includes providing the pre-flanged forming portion of the forming material with a size that is equal to or less than an outside diameter of the trunk portion.

8. The flanged component forming method according to claim 7, wherein the holding of the forming material includes providing the pre-flanged forming portion of the forming material with excess material in positions that correspond to a shape of the flange after formation.

9. A flanged component forming device for forming a flanged housing member comprising:

a first die including an external forming surface that is configured and arranged to size an initial portion of a trunk portion of a forming material having a pre-flanged forming portion that is disposed at one end of the trunk portion;

a second die including an internal forming surface that is configured and arranged to cooperate with the first die to iron the initial portion of the trunk portion to a prescribed length; and a flange-forming die configured and arranged to sandwich and press the pre-flanged forming portion of the forming material against the first die to form a flange portion on the one end of the trunk portion, the first and second dies being further configured and arranged to cooperate to size a remainder portion of the trunk portion after the flange-forming die has sandwiched and pressed the pre-flanged forming portion.

10. The flanged component forming device according to claim 9, wherein the flange-forming die is further configured and arranged to set, as a sandwiching and pressing position to sandwich and press the pre-flanged forming portion, a position at which one of the first and second dies has only partially sized the trunk portion of the forming material in an axial direction of the trunk portion.

11. The flanged component forming device according to claim 9, wherein the second die is held by a fixing device in a fixed position when the flange portion is being formed by sandwiching and pressing the forming material with the flange-forming die.

12. The flanged component forming device according to claim 9, wherein the flange-forming die includes a flange forming recess formed on a surface against which the forming material is pressed into by the first die to form the flange portion.

13. The flanged component forming device according to claim 9, wherein the second die includes a flange forming recess formed on a surface against which the forming material is pressed into by the first die and the flange-forming die to form the flange portion.

14. The flanged component forming device according to claim 9, wherein the first and second dies are further configured and arranged to accommodate the forming material in which the pre-flanged forming portion has a size that is equal to or less than an outside diameter of the trunk portion.

15. The flanged component forming device according to claim 14, wherein the first and second dies are further configured and arranged to accommodate the forming material in which the pre-flanged forming portion is provided with excess material so as to correspond to a shape of the flange after formation.

16. A flanged component forming device for forming a flanged housing member comprising:

first forming means for forming an initial portion of a trunk portion of a forming material having a pre-flanged forming portion that is disposed at one end of the trunk portion;

second forming means for cooperating with the first forming means to iron the initial portion of the trunk portion to a prescribed length; and flange-forming means for sandwiching and pressing the pre-flanged forming portion of the forming material against the first forming means to form a flange portion on the one end of the trunk portion, the first and second forming means cooperating to size a remainder portion of the trunk portion after the flange-forming means has sandwiched and pressed the pre-flanged forming portion.

* * * * *